US012421670B2

(12) United States Patent
Brenny et al.

(10) Patent No.: US 12,421,670 B2
(45) **Date of Patent: *Sep. 23, 2025**

(54) TIE PLATE CENTERING AND INSERTING MACHINE

(71) Applicant: Racine Railroad Products, Inc., Mount Pleasant, WI (US)

(72) Inventors: Christopher Brenny, Burlington, WI (US); Mark Osmak, St. Francis, WI (US)

(73) Assignee: Racine Railroad Products, Inc., Mt. Pleasant, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/646,251

(22) Filed: Apr. 25, 2024

(65) Prior Publication Data

US 2024/0295082 A1 Sep. 5, 2024

Related U.S. Application Data

(63) Continuation of application No. 17/061,685, filed on Oct. 2, 2020, now Pat. No. 11,987,936.

(60) Provisional application No. 62/909,492, filed on Oct. 2, 2019.

(51) Int. Cl.

| | |
|---|---|
| ***E01B 29/32*** | (2006.01) |
| ***E01B 9/46*** | (2006.01) |
| *E01B 29/24* | (2006.01) |

(52) U.S. Cl.

CPC ..... *E01B 29/32* (2013.01); *E01B 9/46* (2013.01); *E01B 29/24* (2013.01)

(58) Field of Classification Search

CPC ..... E01B 29/32; E01B 29/10; E01B 29/24; E01B 9/46

USPC ..... 104/16

See application file for complete search history.

(56) References Cited

U.S. PATENT DOCUMENTS

| | | | | | |
|---|---|---|---|---|---|
| 1,388,277 | A | * | 8/1921 | Maliczinski | E01B 9/60 238/331 |
| 1,634,200 | A | * | 6/1927 | Lee | E01B 9/58 238/375 |
| 4,929,816 | A | * | 5/1990 | Theurer | B23K 11/0073 219/97 |
| 5,063,856 | A | * | 11/1991 | Theurer | E01B 29/32 104/9 |

(Continued)

FOREIGN PATENT DOCUMENTS

| | | | | | |
|---|---|---|---|---|---|
| GB | 274264 | A | * | 1/1927 | E01B 31/28 |

*Primary Examiner* — Zachary L Kuhfuss

(74) *Attorney, Agent, or Firm* — Boyle Fredrickson, S.C.

(57) ABSTRACT

A tie plate inserter assembly on a track mounted machine is provided that is configured to ensure appropriate location of a tie plate and a tie relative to a rail of a railway. The assembly includes a frame supported, at least indirectly, on a chassis of the machine and having a tie plate clamp assembly that includes a self-centering mechanism that centers the tie plate relative to a longitudinal centerline the tie. The tie plate clamp assembly has a first clamp plate and a second clamp plate configured to clamp together to hold the tie plate. The tie clamp assembly also has first and second clamp plates configured to clamp together to hold the tie in place. The assembly may additionally include a tie clamp assembly that can be actuated to center the tie relative to a reference point on the frame.

15 Claims, 17 Drawing Sheets

(56) References Cited

U.S. PATENT DOCUMENTS

| | | | | | |
|---|---|---|---|---|---|
| 5,067,412 | A * | 11/1991 | Theurer | E01B 29/32 | 104/16 |
| 5,305,692 | A * | 4/1994 | Madison | E01B 29/10 | 294/902 |
| 5,431,107 | A * | 7/1995 | Almaraz | E01B 29/24 | 104/2 |
| 5,584,247 | A * | 12/1996 | Almaraz | E01B 29/24 | 104/2 |
| 5,655,455 | A * | 8/1997 | Smith | E01B 29/32 | 104/16 |
| 11,987,936 | B2 * | 5/2024 | Brenny | E01B 9/46 | |
| 2007/0199473 | A1 * | 8/2007 | Fuerst | E01B 29/32 | 104/16 |
| 2007/0283837 | A1 * | 12/2007 | Brenny | E01B 29/32 | 104/16 |
| 2010/0155372 | A1 * | 6/2010 | Battisti | E01B 29/44 | 219/55 |
| 2011/0072998 | A1 * | 3/2011 | Noll | E01B 29/32 | 104/16 |
| 2021/0102345 | A1 * | 4/2021 | Brenny | E01B 9/46 | |

* cited by examiner

TIE PLATE CENTERING AND INSERTING MACHINE

CROSS-REFERENCE TO RELATED APPLICATION

The present application is a continuation of U.S. patent application Ser. No. 17/061,685, filed on Oct. 2, 2020, and entitled *Tie Plate Centering and Inserting Machine*, which claims priority on U.S. Provisional Patent Application Ser. No. 62/909,492, filed Oct. 2, 2019 and entitled *Tie Plate Centering and Inserting Machine*, the entireties of which are hereby incorporated herein by reference.

BACKGROUND OF THE INVENTION

1. Field of the Invention

The invention relates to rail maintenance equipment and, more particularly, relates to a tie plate inserting machine that quickly and automatically centers a tie plate relative to a longitudinal centerline of the tie before inserting the tie plate between a rail and a tie. It additionally relates to a method of inserting a previously positioned tie-plate between a rail and a tie, and more particularly, to center the tie plate relative to the tie prior to the insertion of the tie plate between the rail and the tie.

2. Discussion of the Related Art

Tie plates are widely used in railway installations. Specifically, the rails of a railroad track are usually secured to cross ties by spikes driven through tie plates positioned between the rail and the tie. The heads of the spikes overlap the base of the rail, and the tie plates block the rails from lateral movement.

It is often necessary during railway track maintenance and/or construction operations to insert a tie plate beneath the rail. For instance, in a typical tie replacement operation, the spikes are pulled from the tie plates to release the tie from the opposed rails. Then a machine pulls the tie out from beneath the rails, knocking the tie plates loose as the tie is withdrawn. A laborer then retrieves the tie plates with a hook and sets them aside. Another machine then inserts a new tie beneath the lifted rails. One or two operators then reinsert the tie plates on the top surface of the tie. The tie plates are then inserted between the tie and the rails, either manually or using a machine. The rails are then lowered onto the tie plate, and new spikes are driven through the tie plates to anchor the rails to the tie.

Prior manual and machine based tie plate insertion techniques exhibit marked disadvantages.

In traditional manual-based tie plate insertion techniques, a winch or some other device is used to lift the rail from the tie sufficiently to provide clearance for a tie plate. Operators then place the tie plate on the tie adjacent the rails and push the tie plates beneath the rails, sometimes using a tool. Such manually operated tools are disclosed in U.S. Pat. No. 3,882,785 to Rowe and U.S. Pat. No. 6,595,140 to Madison et al. Inserting tie plates using such tools is very labor intensive, adding significantly to the cost of a tie replacement operation. It is also very time consuming—undesirably increasing the time that a railway is out of service for track maintenance operations.

Other machines have been proposed that position and insert tie plates, either in a stand-alone basis or as part of a larger machine that performs other track maintenance operations. These machines are disclosed, for example, in U.S. Pat. No. 5,067,412 to Theurer et al.; U.S. Pat. No. 5,655,455 to Smith; and U.S. Pat. No. 6,158,353 to Theurer. All three of these machines dispense tie plates from a magazine, position the tie plate adjacent the rail, and drive the tie plate beneath the rail using a complex structure. These machines are very complex and expensive to operate. They also have reliability issues resulting from their complexity. They are also relatively slow. Their insertion tools also lack the freedom of movement required to insert a previously positioned tie plate beneath a rail.

Yet another issue with traditional installation of tie plates relative to ties and rails relates to the specific positioning of the tie plate on the tie. To ensure the tie plate, tie, and rail are adequately secured to one another, it is important that the tie plate is centered on the tie before it is inserted beneath the rail. Traditionally, appropriate location of the tie plate relative to the tie required individual workers to manually stage the tie plate on the tie. More specifically, a laborer would pick up the tie plates from a ballast in close proximity to the tie and then place the tie plate on the tie. Unfortunately, because these tie plates are installed manually by a laborer, the tie plates were oftentimes either not consistently staged in the center of the tie and/or the tie plates were not squarely located on the tie to ensure a satisfactory connection between the tie plate, the tie, and the rail. To address these concerns, tie plate inserting machines can be used to manually alter the location of the tie plate during the insertion process. Nevertheless, this manual use of the tie plate inserting machine requires a user to enable front and back control mechanisms, which is a slow and difficult process. Further still, in many instances the relocation of the tie plate using the tie plate inserting machine is not even possible because use of the front and back mechanism will cause the plate clamp assembly to rotate and jam.

The need therefore has arisen to provide a tie plate inserting machine that is relatively simple to operate yet is capable of reliably and automatically locating a tie plate relative to a tie in a centered fashion before being inserted beneath a rail.

SUMMARY OF THE INVENTION

In accordance with a first aspect of the invention, a tie plate inserting assembly is provided that ensures appropriate location of a tie plate relative to a tie during insertion. The machine includes a frame, a tie clamp assembly movably connected to the frame, and a tie plate clamp assembly connected to the frame. Upon engagement of the tie clamp assembly with the tie, the tie plate clamp assembly centers the tie plate relative to a longitudinal centerline of the tie. The machines may also include a second frame on a second side of the machine to enable tie plates to be installed on both side of the tie simultaneously. One or more centering mechanisms are provided to assure centering of the tie plate relative to a longitudinal centerline of the tie. It or they may also assure centering of the tie relative to a reference point on the frame.

The tie plate clamp assembly may include a first clamp plate, a second clamp plate opposite the first clamp plate, and a first centering mechanism that is configured to ensure that the first clamp plate and the second clamp plate are equidistantly located from a reference point on the frame such as a center point. The first centering mechanism may be a rack and pinion assembly. The tie plate clamp assembly may also include a first hydraulic cylinder, where the first hydraulic cylinder is actuatable to move the tie plate clamp assembly from an opened position to a closed position. When in the opened position, the tie plate is spaced from at least one of the first clamp plate and the second clamp plate. When in the closed position, the tie plate is clamped between the first clamp plate and the second clamp plate. This may be achieved by having a first end of the first hydraulic cylinder affixed to the first clamp plate and a second end of the first hydraulic cylinder affixed to the second clamp plate.

The tie clamp assembly may also include a third clamp plate, a fourth clamp plate opposite the third clamp plate, and a second centering mechanism that is configured to ensure that the third clamp plate and the fourth clamp plate are equidistantly located from the reference point in the frame. The third clamp plate and fourth clamp plate may include a top portion and first and second tapered edges that extend downwardly to form a v-shaped wedge. The tie clamp assembly may also include a second hydraulic cylinder that moves the third and fourth clamp plates from an opened position to a closed position where the tie is clamped by the third and fourth clamp plates. For instance, a first end of the second hydraulic cylinder may be affixed to the third clamp plate and a second end may be affixed to the fourth clamp plate.

In accordance with another aspect of the invention, a method is provided of centering a tie plate relative to a tie. The method includes locating a frame of a tie plate inserter assembly over the tie and the tie plate. A tie plate clamp assembly then is clamped to a tie plate, and a tie clamp assembly is clamped to a tie. When this occurs, the tie plate is centered relative to a longitudinal centerline of the tie using a centering mechanism mounted on the frame. Additionally, the method may include the steps of relatively moving a first clamp plate and a second clamp plate associated with the tie plate clamp assembly towards one another to position the tie plate at the center of the frame, as well as relatively moving a third clamp plate and a fourth clamp plate associated with the tie clamp assembly towards one another to position the tie at the center of the frame. Further still, the method may include actuating first and second centering mechanisms of the tie plate clamp assembly and the tie clamp assembly, respectively, that enable the clamp plates to remain equidistant the center of the frame. Also, the method may include actuating a first hydraulic cylinder to clamp the first clamp plate and the second clamp plate to the tie plate and actuating a second hydraulic cylinder to clamp the third clamp plate and the fourth clamp plate to the tie. The method may also include the step of rotating a circular pinion of a rack and pinion mechanism to translate a rack of the rack and pinion mechanism in a first direction, and translating a second rack of the rack and pinion mechanism with the pinion in a second direction opposite the first direction. The first rack may be associated with the first clamp plate, and the second rack may be associated with the second clamp plate, such that the first clamp plate and the second clamp plate move in opposite directions while remaining equidistant from the center of the frame during pinion rotation. Further still, at least one sensor may be utilized to determine the position of the tie plate relative to the tie. More specifically, when the sensor detects that the tie plate is not centered on the tie, the tie plate clamp assembly may be moved to the opened position, after which the first clamp plate and the second clamp plate can be returned to the closed position to clamp the tie plate at the center of the tie.

BRIEF DESCRIPTION OF THE DRAWINGS

A preferred exemplary embodiment of the invention is illustrated in the accompanying drawings in which.

DETAILED DESCRIPTION OF THE PREFERRED EMBODIMENT

As indicated in the Summary portion above, the invention relates to a track mounted machine that is capable of inserting a previously positioned tie plate between a rail and underlying cross tie of a railway. The machine preferably is also capable of lifting the rail from the tie prior to tie plate insertion and/or, is capable of operating on both rails of a railway simultaneously. Also, the machine is equipped with a tie plate centering mechanism that centers the tie plate relative to the tie prior to tie plate insertion. One possible configuration includes two tie plate inserter assemblies mounted on a common workhead. Each tie plate inserter assembly includes a pusher that can be moved, under control of an operator stationed on the machine, vertically and longitudinally of the rails so as to be aligned with a field end of the tie plate. Additionally, each pusher includes a tie plate centering mechanism to enable the centering of the tie plate relative to the tie prior to insertion. The pusher can then be actuated to push the tie plate laterally under the rail after the tie plate has been centered about the tie. A variety of machine configurations are capable of operating in this manner.

Figure 1:
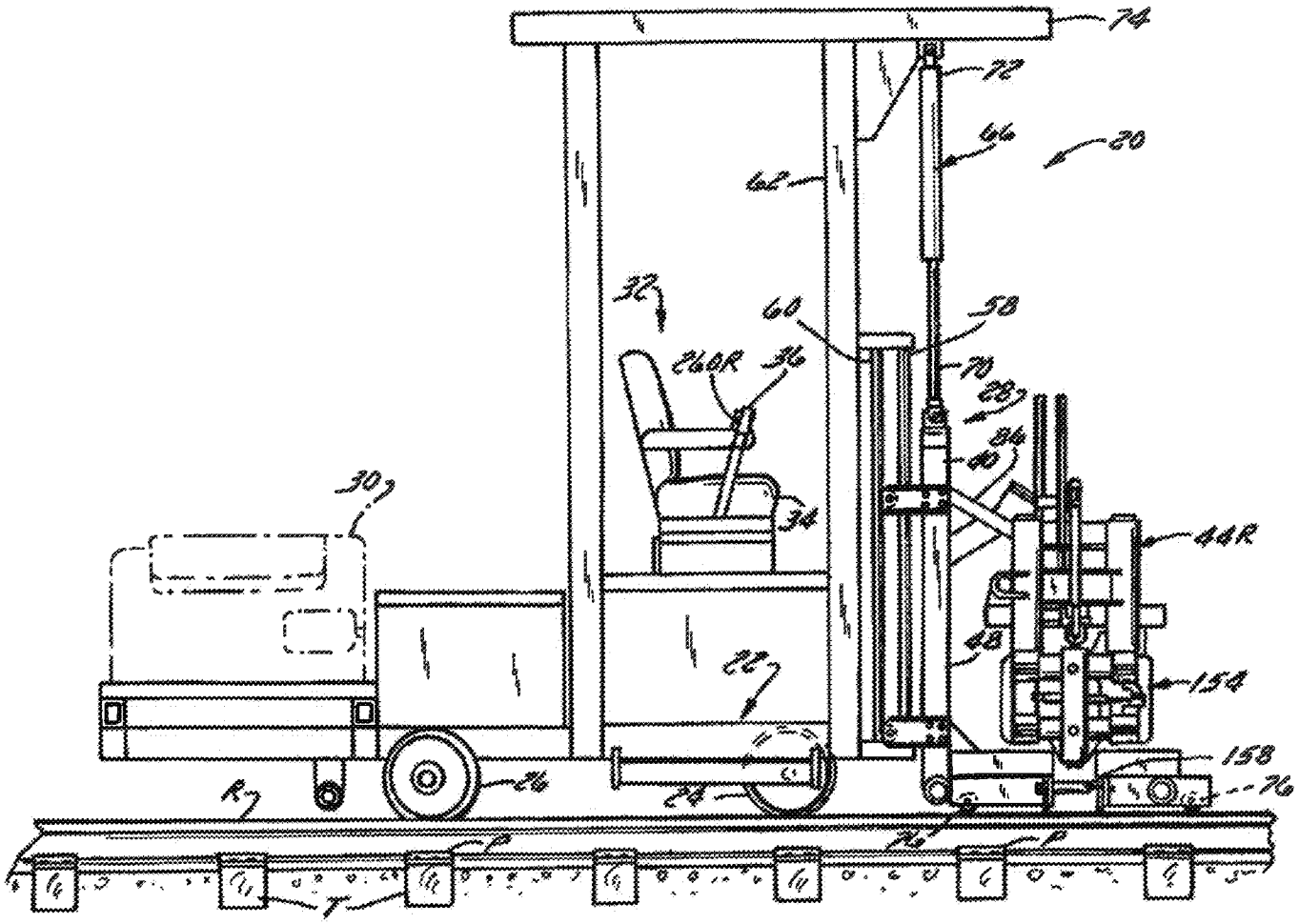
FIG. 1 is a side elevation view of a tie plate inserting machine constructed in accordance with a preferred embodiment of the present invention.
Figure 2:
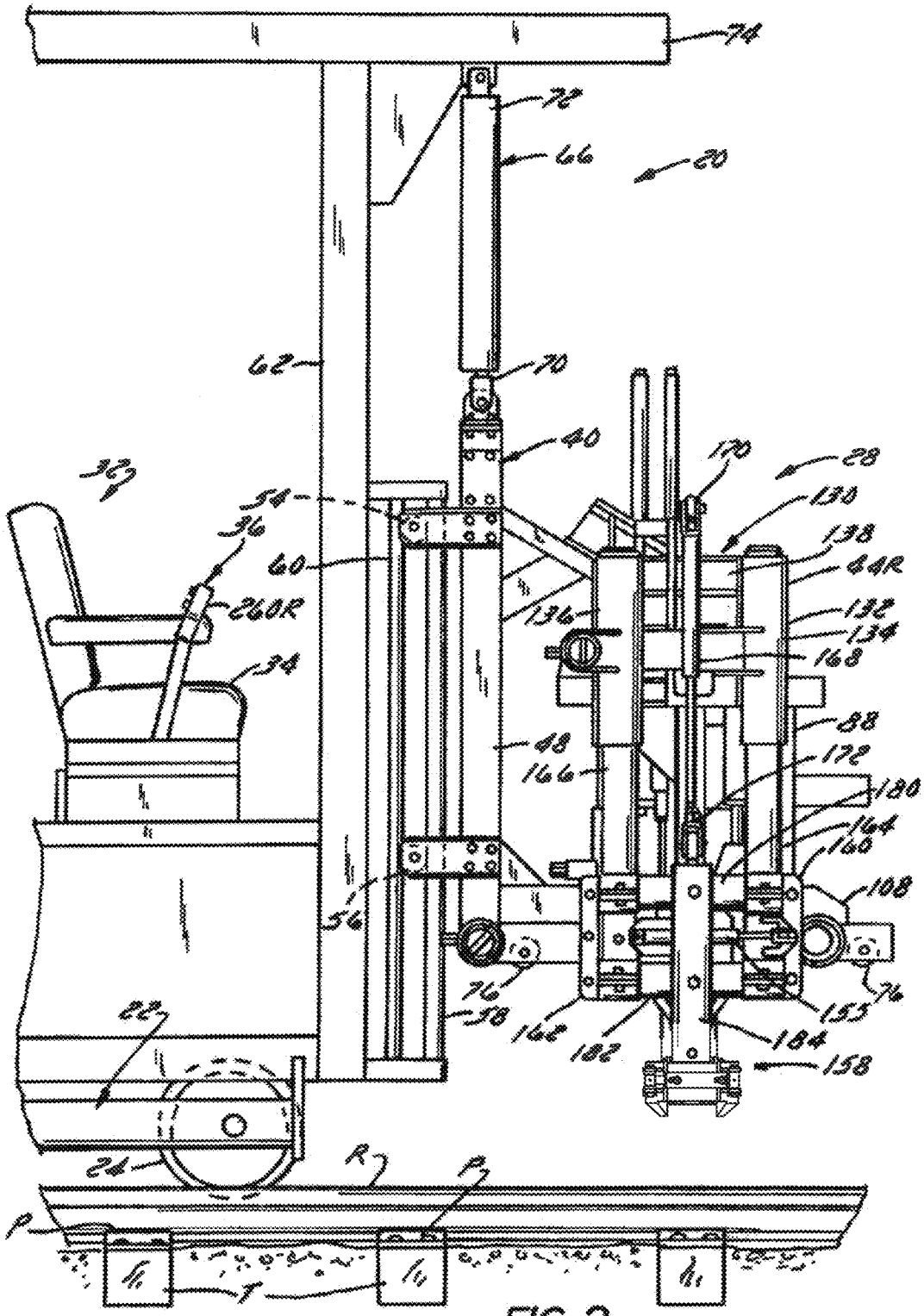
FIG. 2 is a side elevation view of a workhead and the front portion of the tie plate inserting machine of FIG. 1.
Figure 3:
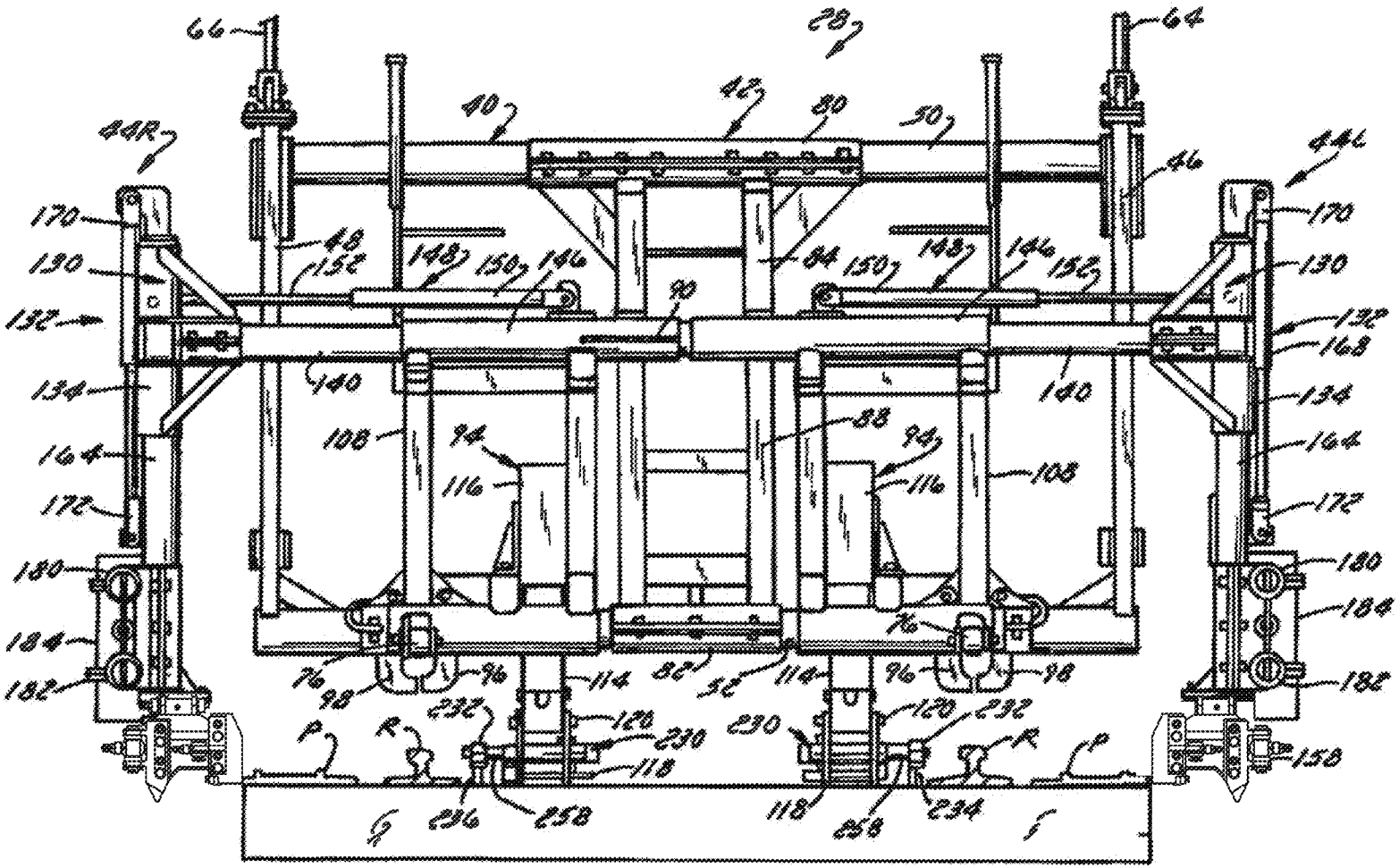
FIG. 3 is a front end view of the workhead of FIGS. 1 and 2.

Referring initially to FIGS. 1-3, a tie plate inserting machine 20 constructed in accordance with the preferred embodiment of the invention includes a chassis 22 that is mounted on the rails R by front and rear wheels 24 and 26 and that supports a workhead 28 at its front end. The chassis 22 is preferably self-propelled by an engine 30 located on the rear of the machine 20. An operator's station 32 is supported on the chassis 22 behind the workhead 28. The operator's station includes a seat 34 and controls 36, detailed below.

The workhead 28 includes a support frame 40, an inserter support carriage 42 mounted on the frame 40 for movement there along laterally of the rails R, and left and right tie plate inserter assemblies 44L, 44R mounted on the inserter support carriage 42, each of which is operative to insert tie plates P between a tie T and an associated one of the left and right rails R. The tie plate inserter assemblies 44L, 44R thus are supported on opposed sides of the chassis via the carriage 42 of the workhead 28.

The frame 40 includes left and right vertically spaced struts 46, 48 and upper and lower cylindrical support beams 50, 52 affixed to the ends of the struts 46, 48 to form a rectangular structure. The struts 46, 48 are mounted for vertical movement along the chassis by left and right sets of upper and lower roller assemblies 54, 56, each of which is mounted on an associated vertical strut 46, 48 of the frame 40. Each set of roller assemblies 54, 56 ride along a vertical rail 58, 60 on a support frame 62 of the chassis 22. This vertical movement is effected via a pair of hydraulic cylinders 64, 66, each of which has a rod end 68 attached to an associated strut 46, 48 and a barrel end 70 attached to a cantilevered support 74 located above the rails 58, 60. Each cylinder 64, 66 can be selectively extended and retracted to lower the workhead 28 from a raised, transport position to a lowered, operative position. It should be noted that the cylinders 64, 66 are extended during normal use of the machine 20, i.e., as the machine travels from tie to tie, and is raised only when the machine 20 is transported to or from the worksite. When the workhead 28 is lowered by cylinder extension, it is partially supported and guided on the rails R during insertion operations by rollers 76 mounted on the inserter support carriage 42.

Figure 4:
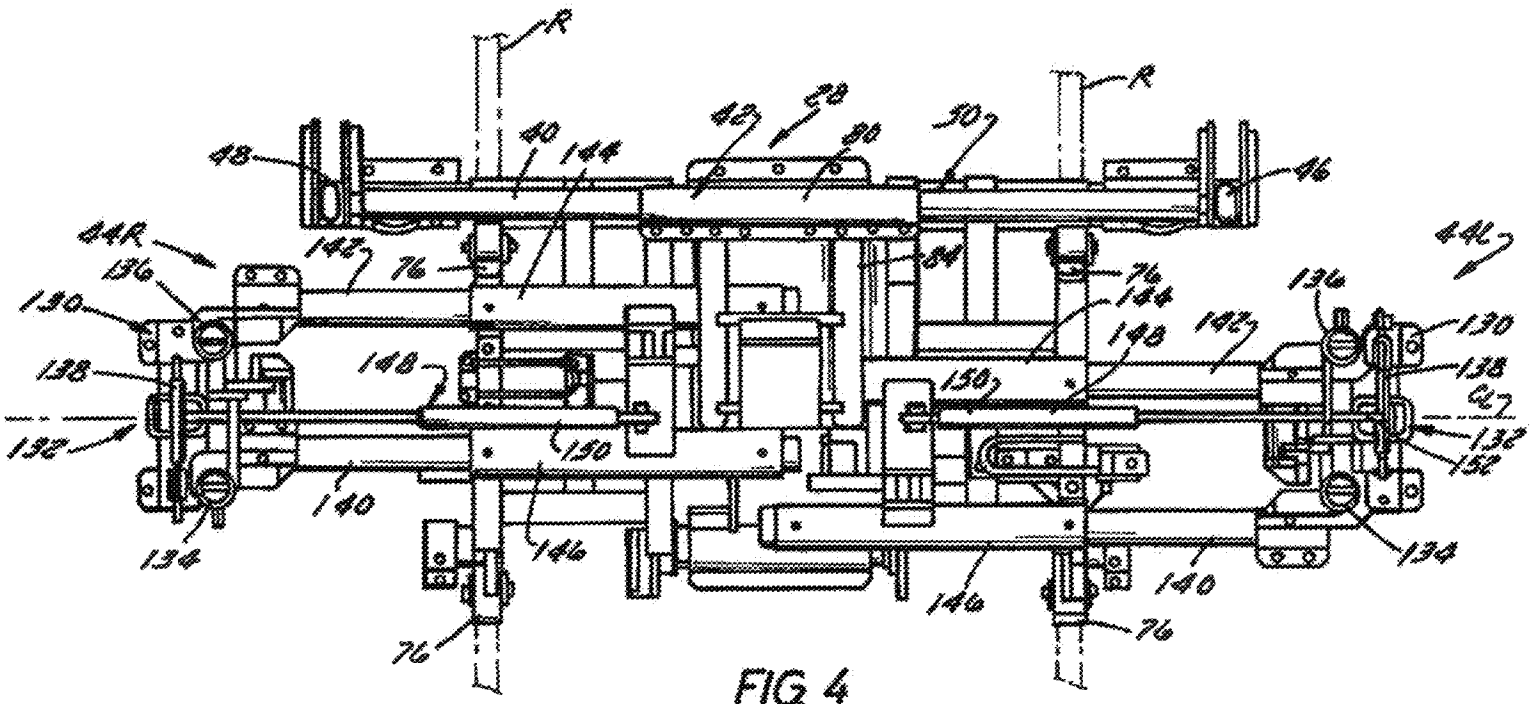
FIG. 4 is a top plan view of the workhead of FIGS. 1-3.
Figure 5:
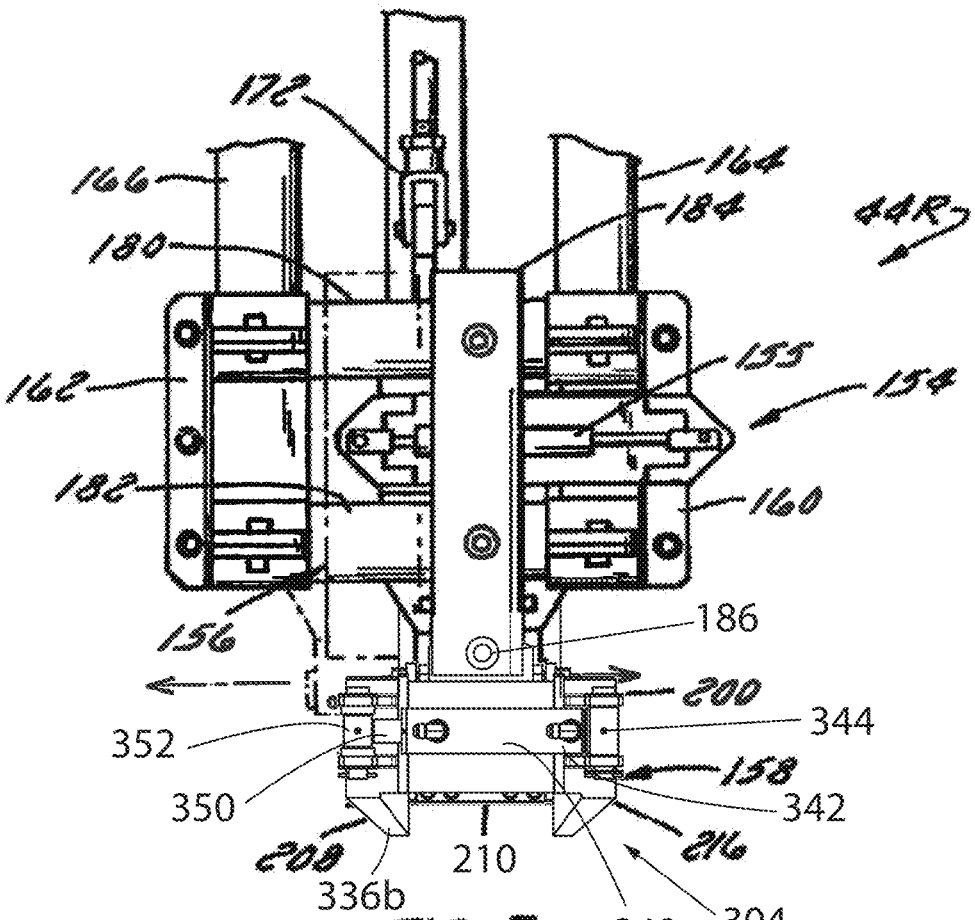
FIG. 5 is a field side elevation view of a tie plate inserter assembly of the workhead.

As best seen in FIGS. 3 and 4, the inserter support carriage 42 is mounted on the beams 50 and 52 by upper and lower sleeves 80, 82 that permit the carriage 42 to move laterally of the rails R. Upper and lower frame assemblies 84, 86 extend forwardly from the sleeves 80, 82 and are affixed to one another by a framework 88. The inserter support carriage 42 is driven along the beams 50, 52 by a laterally extending hydraulic cylinder 90 (FIG. 3) affixed to the carriage 42 at one end and to the support frame 40 at another. The cylinder 90 can be selectively actuated to center the inserter support carriage 42 over the rails R as needed, which typically should be required only on arrival at a worksite, if at all.

Each side of the workhead 28 preferably incorporates mechanisms to lift the rail R from the tie T during a tie plate insertion operation. Referring to FIGS. 1-3, and 6-7, these mechanisms preferably each take the form of a rail clamp 92 and a jack 94 mounted on opposite sides of the inserter support carriage 42. Both of these structures may be any of the type that are typically used in rail maintenance equipment.

Figure 6:
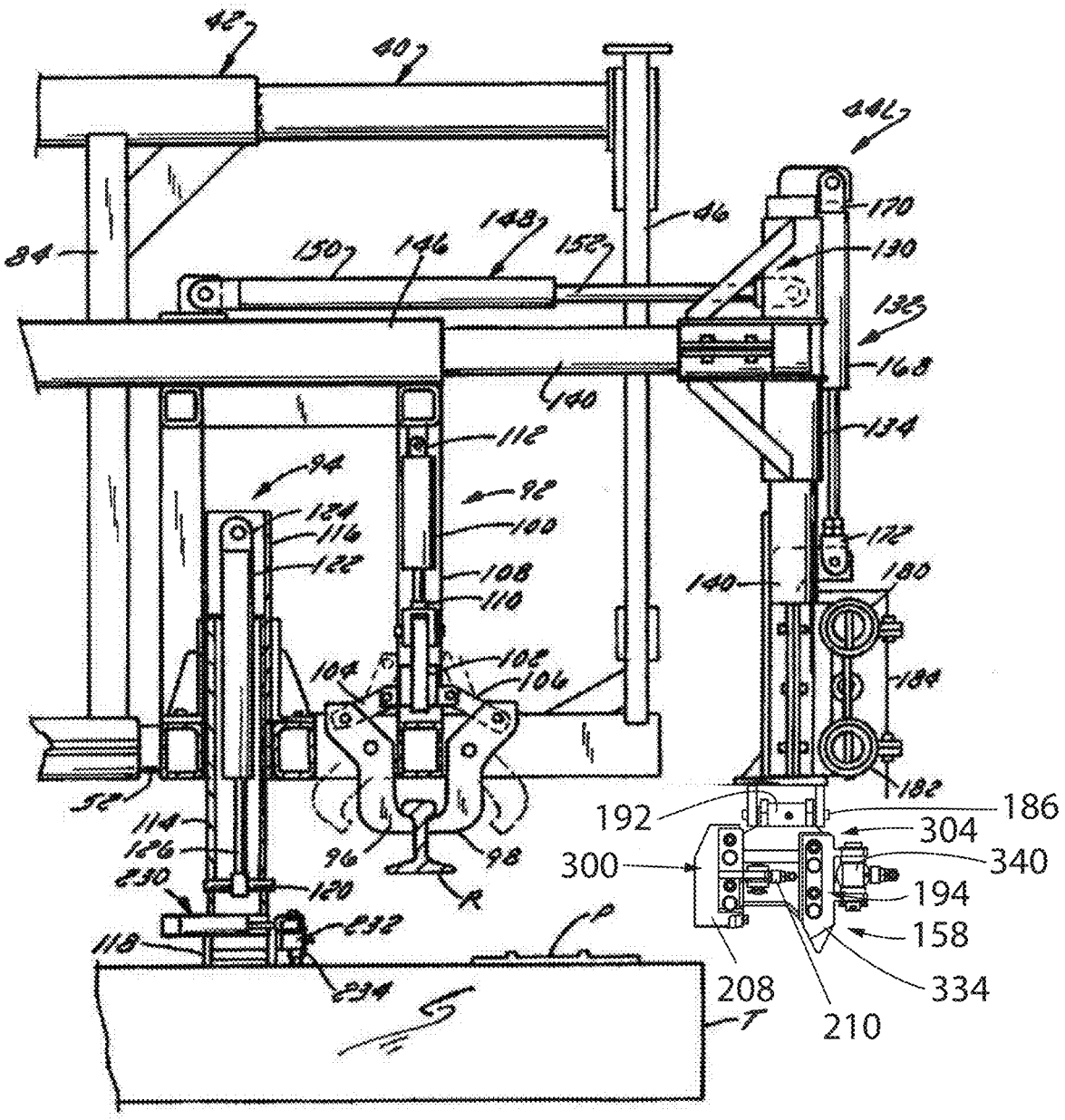
FIGS. 6-9 are a series of rear end elevation views illustrating the use of one of the tie plate inserter assemblies of the tie plate inserting machine to drive a tie plate beneath a rail.
Figure 7:
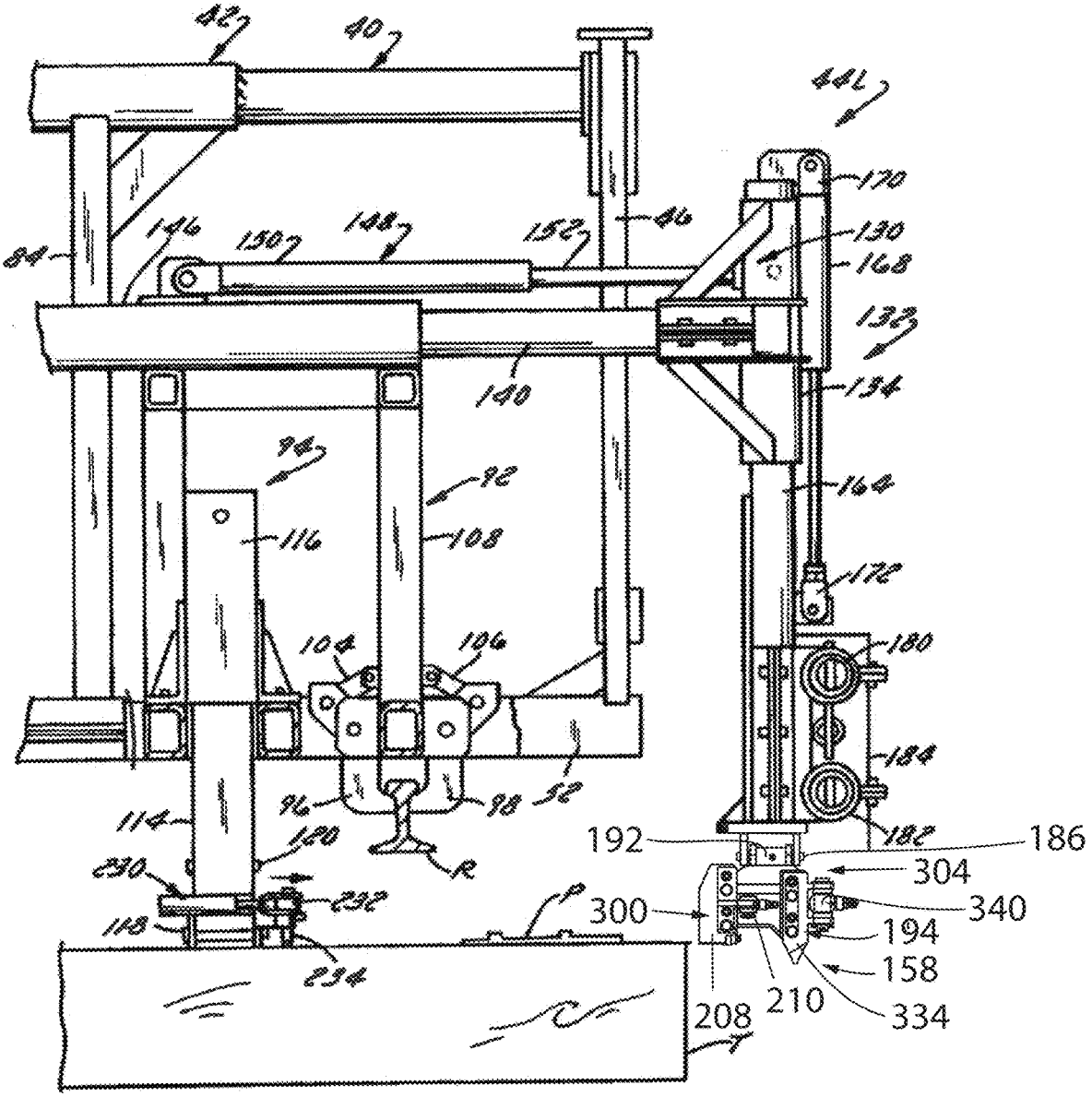
Figure 8:
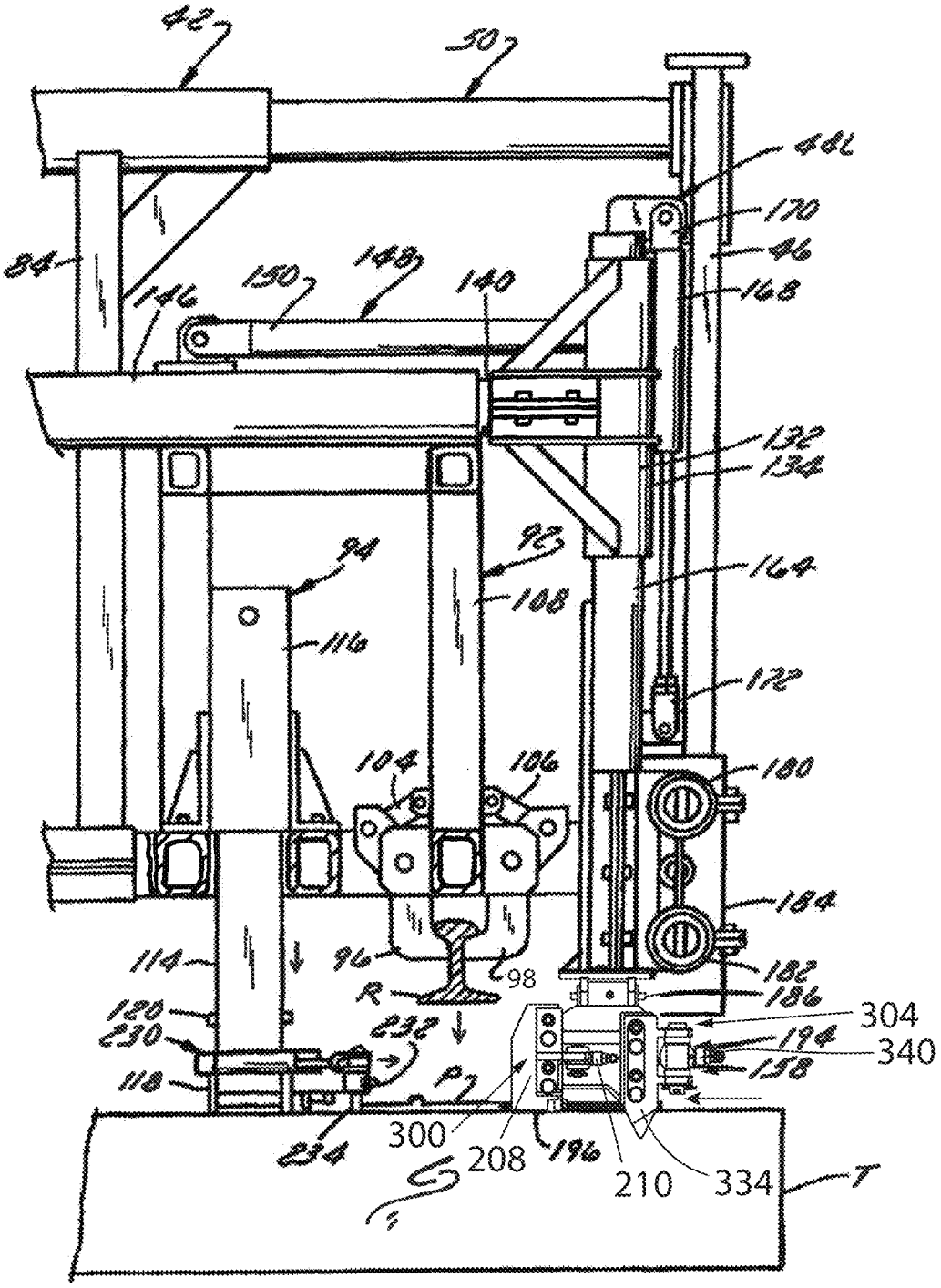

Referring particularly to FIG. 6, the rail clamp 92 of the embodiment includes a pair of pivoting jaws 96, 98 that are operated by a hydraulic cylinder 100 to swing from a disengaged position as seen in phantom lines in FIG. 6 to an engaged position as seen in solid lines in FIGS. 6 and 7. Each of the jaws 96, 98 is pivotally mounted on the lower frame assembly 86 of the inserter support carriage 42 at its midpoint and is connected to a slide 102 at its upper end by a link 104, 106. The slide 102 is mounted for vertical movement within a tube 108 so as to open and close the jaws 96, 98 upon vertical movement within the tube 108. The cylinder 100 is also located in the tube 108 and has a lower, rod end 110 attached to the slide 102 and an upper, barrel end 112 attached to the upper frame assembly 84 of the inserter support carriage 42.

Figure 9:
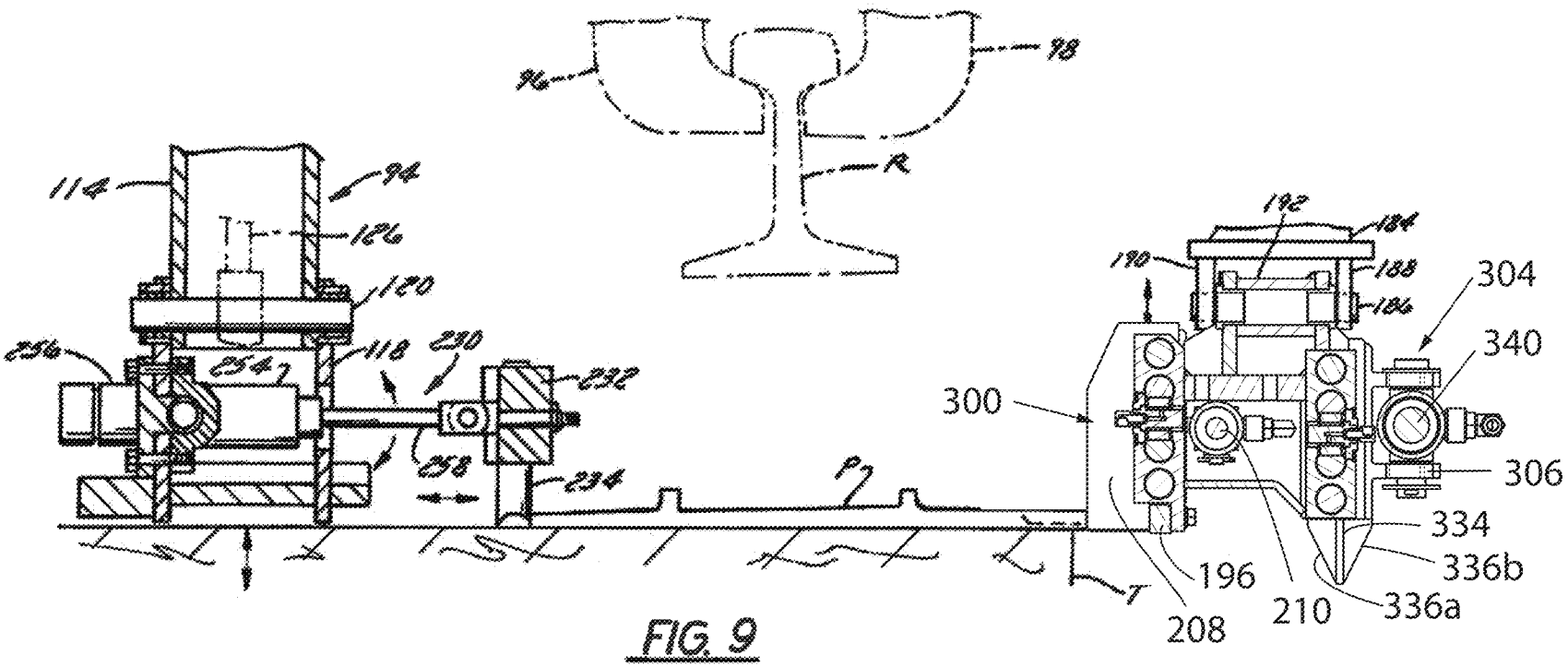
Figure 14:
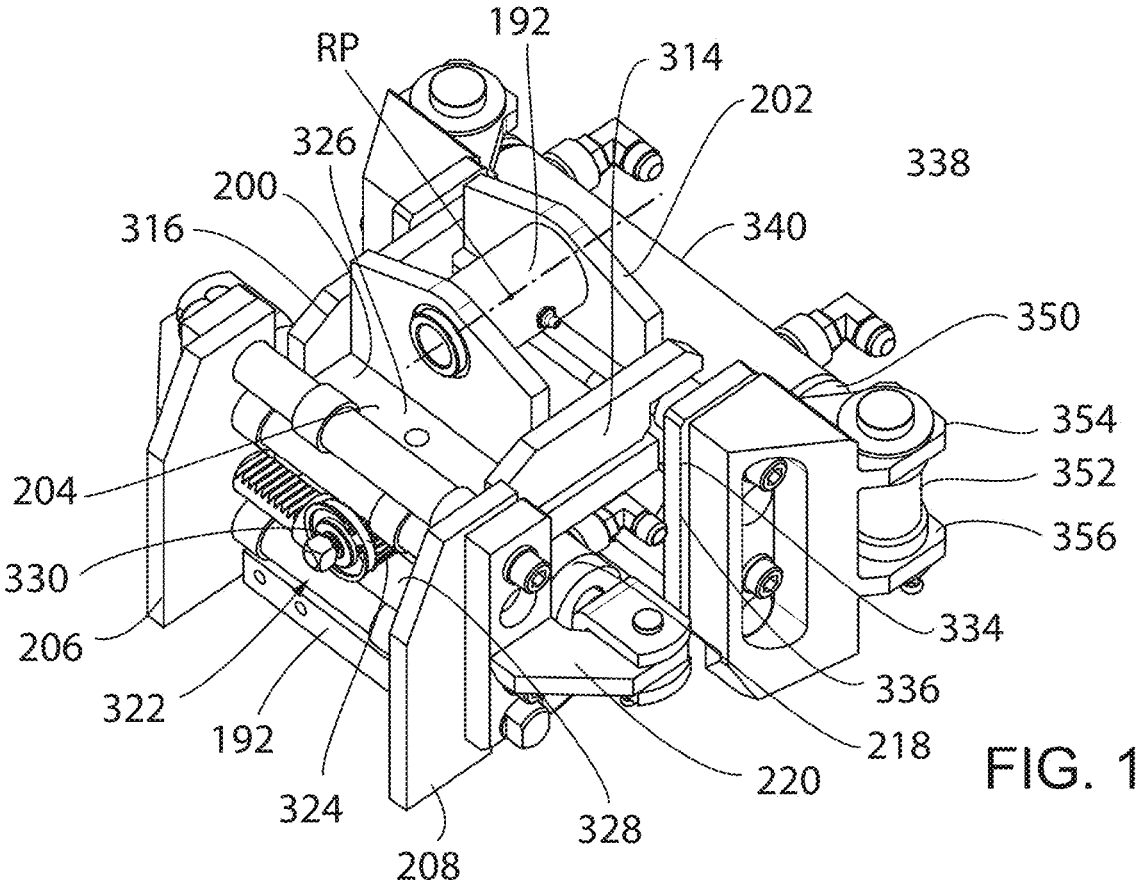
FIG. 14 is a top, first side isometric view of the tie plate inserter centering mechanism of FIGS. 10-13 with a first side plate removed.
Figure 15:
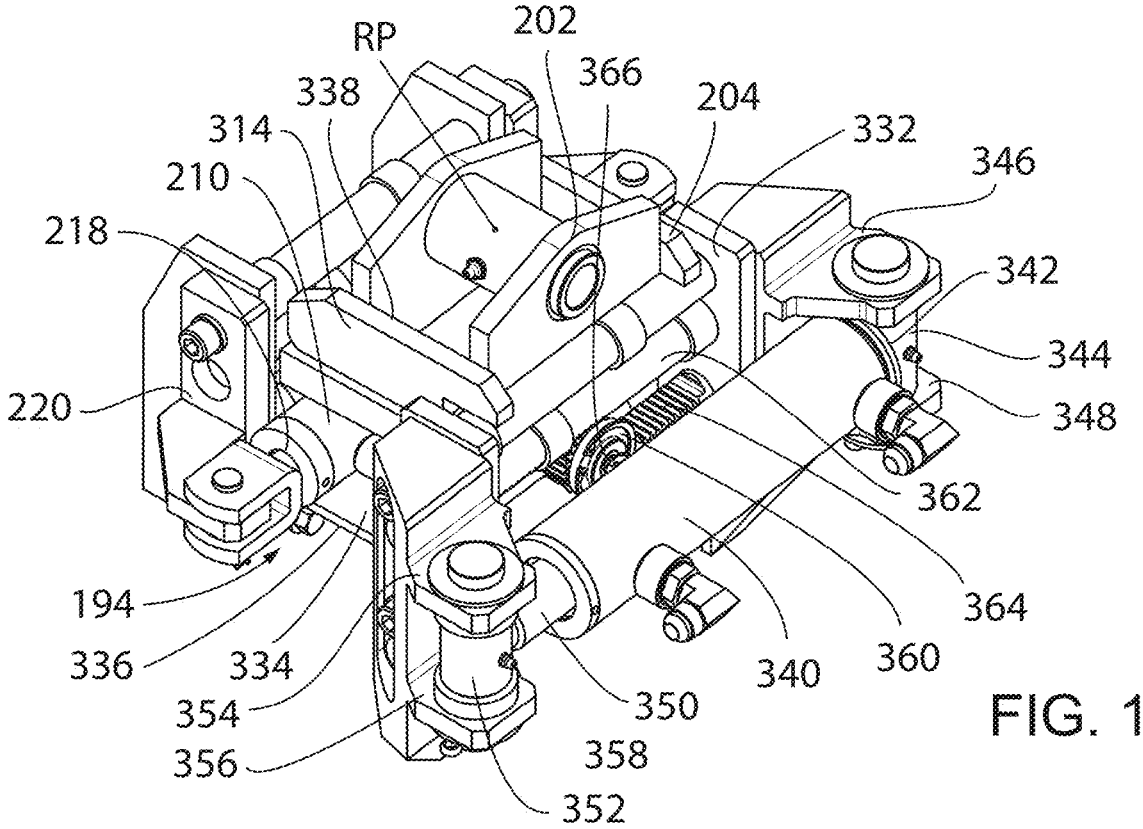
FIG. 15 is a top, second side isometric view of the tie plate inserter centering mechanism of FIGS. 10-14 with a second side plate removed.

Referring to FIGS. 6-9 and FIG. 6 in particular, the jack 94 preferably comprises a hydraulically operated telescoping jack including a movable inner lift leg 114 and an outer stationary tube 116. The outer tube 116 is affixed to the lower frame assembly 86 of the inserter support carriage 42. The bottom end of the lift leg 114 terminates in a foot 118 that is pivotally attached to the leg by a pivot pin 120 as best seen in FIGS. 9, 14, and 15 so as to accommodate some tilting of the tie T. The foot 118 has a hollow interior so as to receive the supports for a hard stop 230, described below. Referring again to FIG. 6, a hydraulic cylinder 122 is positioned within the tube 116 and has an upper, barrel end 124 attached to the tube 116 and a lower, rod end 126 attached to the lift leg 114. Extension or retraction of the cylinder 122 telescopes the lift leg 114 downwardly from the tube 116 to first engage the tie T and thereafter lift the workhead 28 and, accordingly, the rail R relative to the tie T.

The left and right tie plate inserter assemblies 44L, 44R assemblies are preferably of identical construction and, as best seen in FIG. 4, are mounted on the workhead 28 in a mirror image fashion such that the centers of the pushers 158 of the tie plate inserter assemblies 44L, 44R are bisected by a common laterally extending center line CL. Since each of the tie pate inserter assemblies 44L, 44R is identical in operation and construction, only the right assembly 44R will be described, it being understood that the description applies equally to the left assembly 44L.

Referring to FIGS. 2-4, the right tie plate inserter assembly 44R includes a frame 130 mounted on the inserter support carriage 42 for lateral movement relative to the rails R and a pusher assembly 132 mounted on the frame 130. The frame 130 includes front and rear vertically extending support tubes 134, 136 mounted on a weldment 138. The weldment 138 is mounted on front and rear horizontal rods 140, 142, each of which is telescopically received in an associated horizontally extending support tube 144, 146 fixed to the inserter support carriage 42. This telescoping motion is affected by a cylinder 148 that is connected to the inserter support carriage 42 at its inner, barrel end 150 and to an upper tube of a pusher support carriage 154 (detailed below) at its outer, rod end 152. Extension or retraction of cylinder 148 during the pusher assembly laterally toward or away from the rail R.

Referring to FIGS. 2-5, the pusher assembly 132 comprises a vertically movable first carriage 154, a second carriage 156 that is horizontally movable relative to the first carriage 154 longitudinally of the rail R, and a pusher 158 mounted on the second carriage 156. The first carriage 154 includes front and rear vertical supports 160, 162 linked to one another by upper and lower rods (not shown). The upper ends of the supports 160, 162 are mounted on the lower ends of front and rear vertically extending, longitudinally spaced rods 164, 166, the upper ends of which are telescopically received in guide tubes 134, 136 of frame 130. The first carriage 156 is driven for vertical movement relative to the guide tubes 134, 136 by a vertically extending hydraulic cylinder 168 connected to the weldment 138 at its upper, barrel end 170, and to the first carriage 154 at its lower, rod end 172.

Still referring to FIGS. 2-5, the second carriage 156 comprises upper end lower tubes 180, 182 slidably mounted on longitudinally extending rods (not shown) of the first carriage 154. It is driven along the rod by a cylinder 155. It additionally includes a vertically extending mounting tube 184 mounted on the tubes 180, 182. The pusher 158 is pivotally mounted on the bottom of the mounting tube 184 by a pivot pin 186 that allows limited swinging movement of the pusher 158 about a horizontal axis extending laterally of the rails R. More specifically, pivot pin 186 extends through ear mounts 188, 190 projecting downwardly from the bottom of the mounting tube 184 and through a bearing 190 of the pusher 158. The passive swinging movement provided by pivot pin 186 permits the pusher 158 to accommodate limited tilt of a tie T while still resting flat on top of the tie T.

Referring now to FIGS. 10-19, the pusher 158 comprises a support frame 194, a push plate 196, and a tie plate centering mechanism 198 that is configured to move the tie plate P transversely of the tie plate T to center the tie plate relative to longitudinal centerline of the tie T. The tie plate centering mechanism 198 includes a tie plate clamp assembly 300 on a first side 302 of the frame 194 and a tie clamp assembly 304 on a second side 306 of the frame 194. The frame 194 includes the bearing 192, a pair of vertical plates 200, 202 that extend downwardly from the bearing 192, a top horizontal mounting plate 204 extending between the vertical plates 200, 202, and laterally therefrom, and a bottom horizontal mounting plate 308 extending from the tie plate clamp assembly 300 rearwardly towards the tie clamp assembly 304. The top horizontal mounting plate 204 extends from the tie plate clamp assembly 300 to the tie clamp assembly 304. Additionally, the frame 194 includes a first side mounting plate 310 and a second side mounting plate 312. The first side mounting plate 310 is associated with the tie plate clamp assembly 300 and affixes to the frame 194 at the first side 302. The second side mounting plate 312 is associated with the tie clamp assembly 304 and affixes to the frame 194 at the second side 306. Each of the mounting plates provide structural rigidity to the pusher 158 and the frame 194 while the tie plate centering mechanism 198 is operated. The frame 194 may also have additional vertical plates 314, 316 running perpendicular and affixed to the vertical plates 200, 202 to ensure a secure connection between the bearing 192 and the top horizontal mounting plate 204.

The tie plate clamp assembly 300 will now be described, specifically referring to FIGS. 10-15. As will be described herein, the tie plate clamp assembly 300 is located on the first side 302 of the frame 194. In operation, since there are tie plate clamp assemblies 300 on both sides of the machine, both of the tie plate clamp assemblies 300 will be located on the inner side closest to the center of the machine 20. Only one tie plate clamp assembly 300 will be described, but it will be appreciated that the tie plate clamp assembly located on the opposite side of the machine will be a mirror image of the described tie plate clamp assembly 300.

Figure 17:
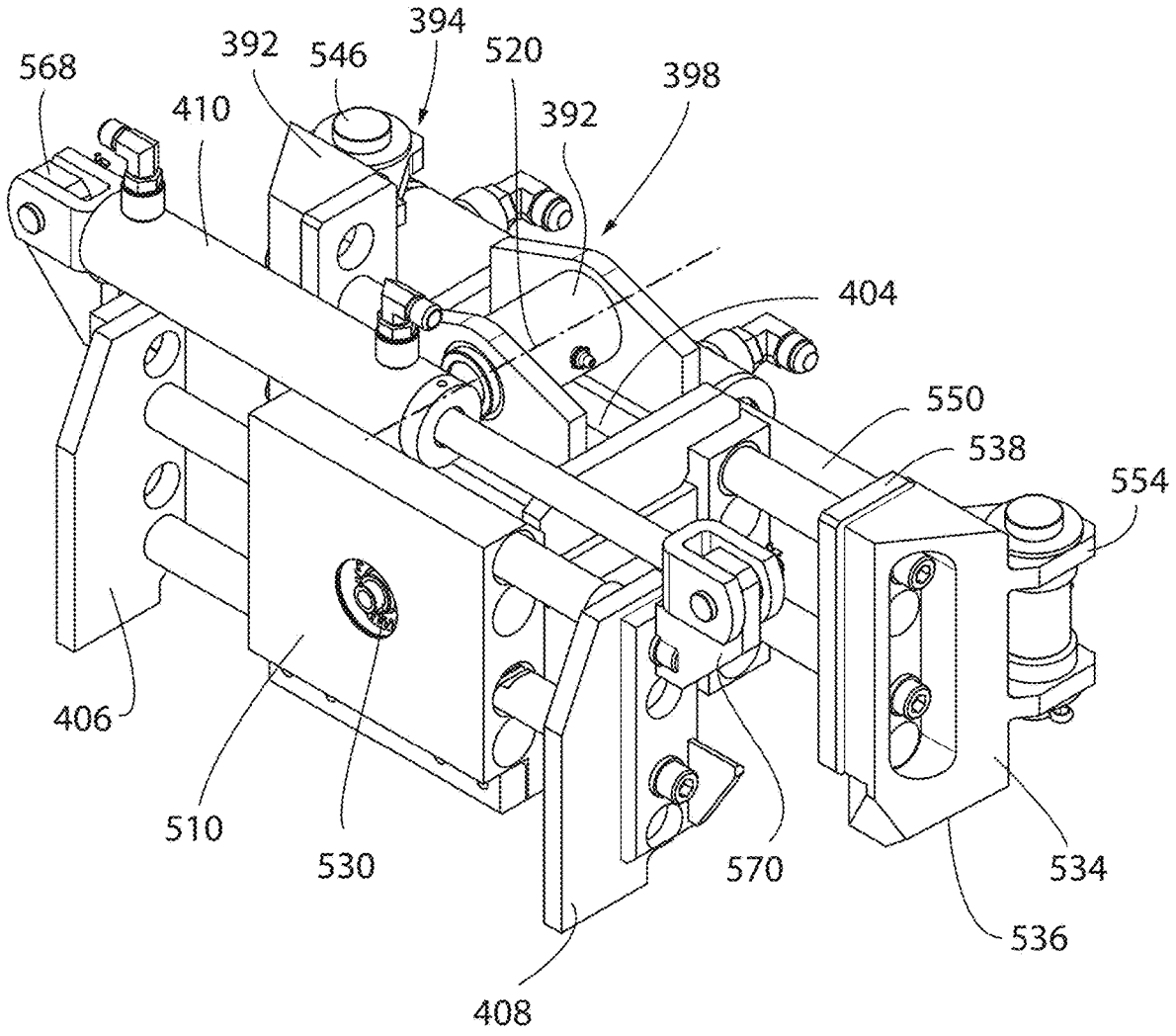
FIG. 17 is a top, first side isometric view of the tie plate inserter centering mechanism of FIG. 16 in an opened position.
Figure 18:
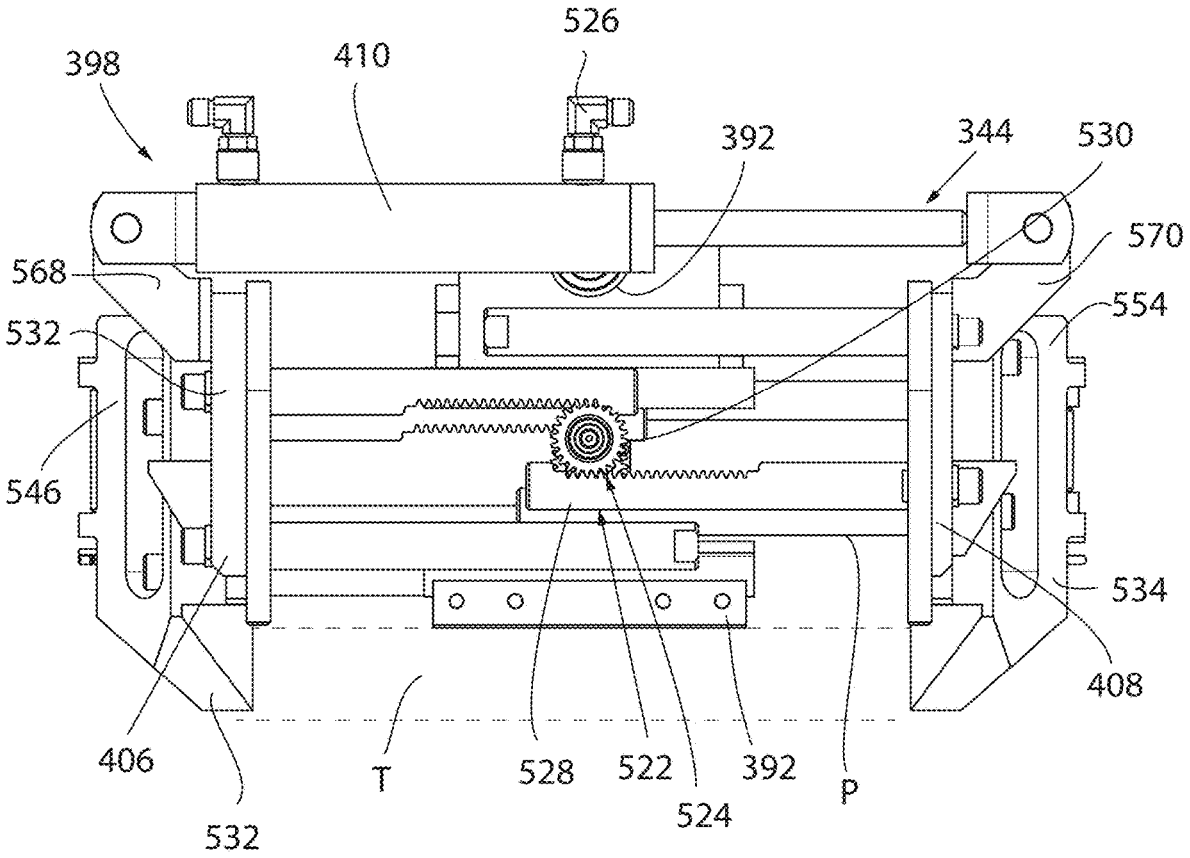
FIG. 18 is a first side elevation view of the tie plate inserter centering mechanism with a first side plate removed.
Figure 19:
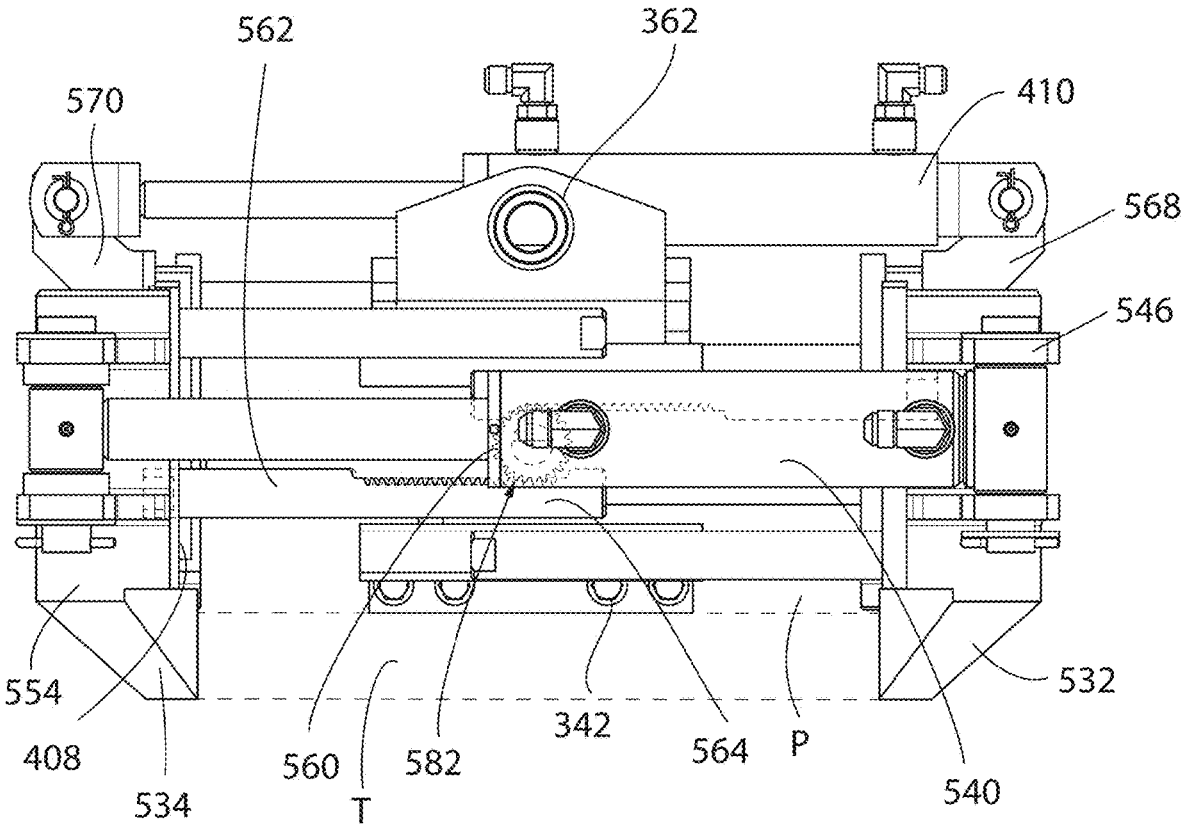
FIG. 19 is a second side elevation view of the tie plate inserter centering mechanism with a second side plate removed.

The tie plate clamp assembly 300 includes first and second clamp plates 206, 208. The clamp plates 206, 208 may take a variety of different configurations. As shown, the clamp plates 206, 208 are generally rectangular in shape with notches cut in opposing corners, where a bottom edge surface is flush with the push plate 196. The clamp plates 206, 208 are movable inwardly and outwardly relative to one another. More specifically, the clamp plates 206, 208 are configured to move the same distance inwardly or outwardly relative to a center line 320 that extends through the center of the frame 194 about the length of the bearing 192. Stated differently, whenever the plates 206, 208 move, each will be the same distance from the center line 320 extending through the length of the bearing 192. This can be achieved by a variety of centering mechanisms that ensure that both plates 206, 208 are centered (moved equidistantly) relative to the frame 194. By using the centering mechanism, the plates 206, 208 can be moved from an opened position in which the plates 206, 208 would not be holding the tie plate P to a closed position in which the tie plate P would be firmly held by the plates 206, 208. FIGS. 10-15 all show the plates in the closed position. FIGS. 17-19 show a similar embodiment in which the plates are in the opened position. Alternatively, one of the two clamp plates 206, 208 may be fixed in place, whereas the other is movable relative to the first clamp plate. Such an embodiment would still allow for the tie plate clamp assembly 300 to center the tie plate P relative to the tie T without requiring both clamp plates 206, 208 to move relative to the frame 194.

For instance, as shown, the clamp plates 206, 208 are driven to move relatively to one another. For instance, a first hydraulic cylinder 210 may drive the plates 206, 208 toward and away from each other. The cylinder 210 is located within the frame 194 and extends outwardly at the front and rear of the first horizontal mounting plate 204. The cylinder 210 has a barrel end 214 attached to an ear mount 216 affixed to the outer surface of one of the clamp plates 206 and a rod end 218 attached to an ear mount 220 affixed to the other clamp plate 208. Thus, when the plates 206, 208 are initially in an opened position, the cylinder 210 can be actuated to a retracted position. When the cylinder 210 is retracted, the barrel end 214 and the rod end 218 move towards one another such that the ear mounts 216, 220, and the clamp plates 206, 208 connected to them, are similarly moved together. When this happens, the tie plate P is clamped between the claim plates 206, 208. Thereafter, once the tie plate P has been inserted, and while still in the closed position, the cylinder 210 can be actuated to an extended position. When this occurs, the barrel end 214 and the rod end 218 move away from one another. By extension, since the ear mounts 216, 220 are affixed to the clamp plates 206, 208, the clamp plates 206, 208 are also moved away from one another to the opened position. Thereafter, the machine 20 can be moved along to the next tie T and tie plate P.

In addition to use of the cylinder 210, the centering mechanism may include additional features to enable movement of the plates 206, 208 such that they remain centered relative to the frame 194. For instance, FIG. 14 shows the frame 194 with the first side mounting plate 310 removed. In this embodiment, the tie plate clamp assembly 300 includes a rack-and-pinion assembly 322 that is centered relative to a reference point on the frame 194, such as a center point of the frame 194. Assembly 322 has a central circular gear or pinion 324 and first and second linear gears or racks 326, 328 located above and below the central circular gear 324. The central circular gear 324 includes a shaft 330 that extends through a center of the first side mounting plate 310. When the cylinder 210 is actuated, the central circular gear 324 rotates and the first and second linear gears 326, 328 are rotated at the same rate to ensure equidistant movement of the plates 206, 208 in opposite directions relative to the reference point on the frame 194. Other centering mechanisms may similarly be employed, including scissor slotted mechanisms, linkages, and the like.

Still looking to FIGS. 10-15, the tie clamp assembly 304 will now be described. As can be seen in these figures, the tie clamp assembly 304 is located on the second side 306 of the frame 194. In operation, since there are tie clamp assemblies 304 on both sides of the machine, both of the tie clamp assemblies 304 will be located on the outer side furthest from the center of the machine. Only one tie clamp assembly 304 will be described, but it will be appreciated that the tie clamp assembly 304 located on the opposite side of the machine will be a mirror image of the described tie clamp assembly 304. Like the tie plate clamp assembly 300, the tie clamp assembly 304 also includes first and second clamp plates 332, 334. The clamp plates 332, 334 may take a variety of different configurations, as shown, a generally V-shaped wedge having a top section with a top edge surface 338, and first and second tapered bottom edge surfaces 336*a*, 336*b* that slope towards one another to form the wedge shape. By having the V-shaped wedge formed by the first and second tapered bottom edge surfaces 336*a*, 336*b*, the clamp plates 332, 334 can more easily clamp down onto and grip the tie T. Additionally, the tapered bottom edge surfaces 336*a*, 336*b* allows the clamp plates 332, 334 to cut through rock or ballast located adjacent to the tie T to avoid collection of the rock or ballast on top of the tie T, which could cause the tie plate P to be offset. Additionally, the bottom edge surfaces 336*a*, 336*b* of the clamp plates 332, 334 for the tie clamp assembly 304 may terminate at a point that is offset from the clamp plates 206, 208 of those of the tie plate clamp assembly 300. More specifically, the clamp plates 332, 334 extend further in a downward direction than the clamp plates 206, 208. This offset enables the clamp plates 332, 334 to securely move beneath the tie T and then grip the tie T, while the clamp plate 206, 208 have a higher elevation to enable securement to the tie plate P, but with little or no contact with the tie T itself.

The clamp plates 332, 334 are movable equidistantly inwardly or outwardly relative to the center line 320 extending through the center of the frame 194. As such, whenever the plates 332, 334 are moved, each will be the same distance from the center line 320. This can be achieved by a variety of centering mechanisms that ensure that both plates 332, 334 are centered relative to the frame 194. By using the centering mechanisms, the plates 332, 334 can be moved from an opened position in which the plates 332, 334 would not be holding the tie T to closed position in which the tie T would be firmly held by the plates 332, 334. Alternatively, one of the two clamp plates 332, 334 may be fixed in place, whereas the other is movable relative to the first clamp plate. Such an embodiment would still allow for the tie clamp assembly 304 to secure the tie T in place without requiring the clamp plates 332. 334 to both move relative to the frame 194 in order to allow the tie plate clamp assembly 304 to center the tie plate P relative to the tie T.

The clamp plates 332, 334 may be coupled to one another by a second hydraulic cylinder 340, and the hydraulic cylinder 340 enables movement of the plates 332, 334 toward and away from each other upon cylinder extension or retraction. As shown, the cylinder 340 is located outside of the frame 194 and extends beyond the second side 306. The cylinder 340 has a barrel end 342 with a pin 344 that extends between first and second ear mount 346, 348 that are affixed to the outer surface of one of the clamp plates 332. Additionally, the cylinder 340 has a rod end 350 with a pin 352 that extends between third and fourth ear mounts 354, 356 that are affixed to the other clamp plate 334. As a result, when the plates 332, 334 are in a closed position in which the tie T is clamped therebetween, the cylinder 340 can be actuated to an extended position. When this occurs, the barrel end 342 and the rod end 346 move away from one another. Because the ear mounts 346, 348, 354, 356 are affixed to the clamp plates 332, 334, the clamp plates 332, 334 are also moved away from one another. When the cylinder 210 is actuated to retract, the barrel end 214 and the rod end 218 move towards another. As a result, the ear mounts 346, 348, 354, 356, and the clamp plates 332, 334 due to their connection to the ear mounts 346, 348, 354, 356, are similarly moved together to the closed position in which the tie T is clamped between the plates 332, 334.

In addition to use of the cylinder 340, the centering mechanism may include additional features to enable movement of the plates 332, 334 such that they remained centered relative to the frame 194. For instance, FIG. 15 shows the frame 194 with the second side mounting plate 312 removed. As shown, the tie clamp assembly 304 includes another rack-and-pinion assembly 358 that is centered about the reference point on the frame 194. Assembly 358 includes a central circular gear 360 and first and second linear gears 362, 364 located above and below the central circular gear 360. The central circular gear 360 includes a shaft 366 that extends through a center of the second side mounting plate 312. When the cylinder 340 is actuated, the central circular gear 360 rotates and the first and second linear gears 362, 364 are rotated at the same rate to ensure equidistant movement of the plates 332, 334 in opposite directions. Other centering mechanisms may similarly be employed as known in the art, including scissor slotted mechanisms, linkages, and the like.

Figure 10:
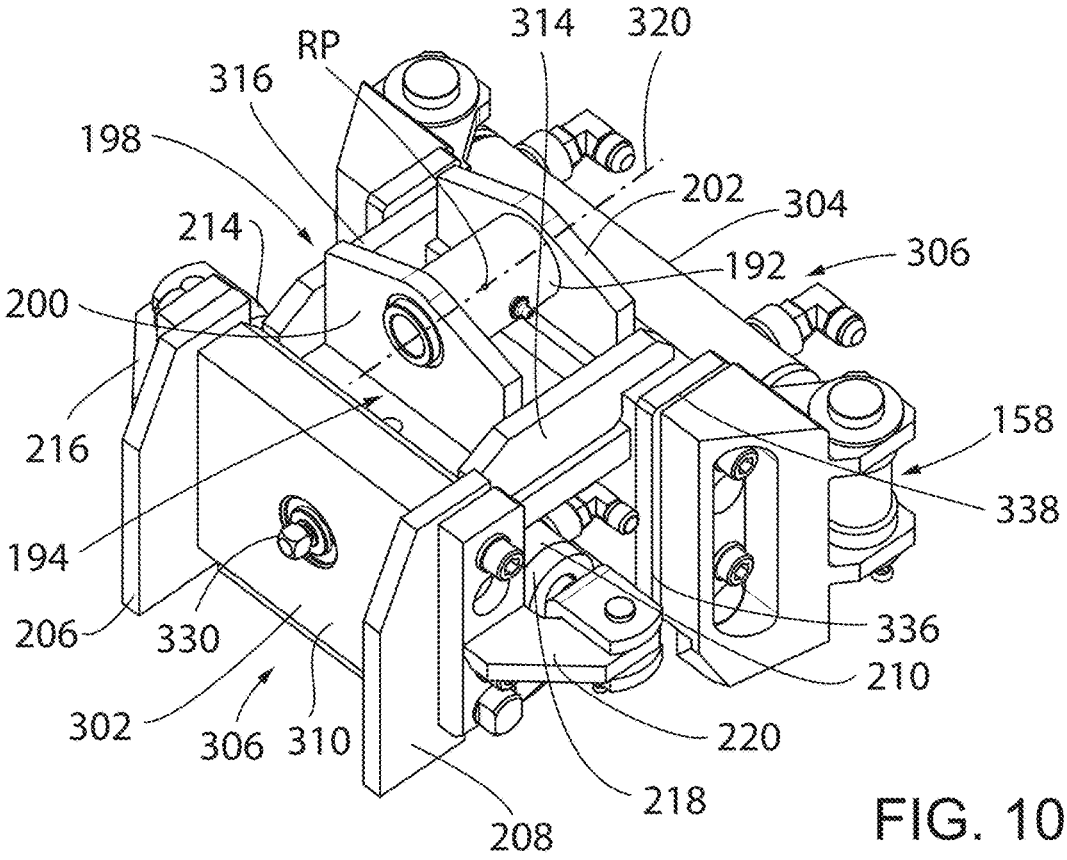
FIG. 10 is a top, first side isometric view of the tie plate inserter centering mechanism of FIGS. 1-9.
Figure 11:
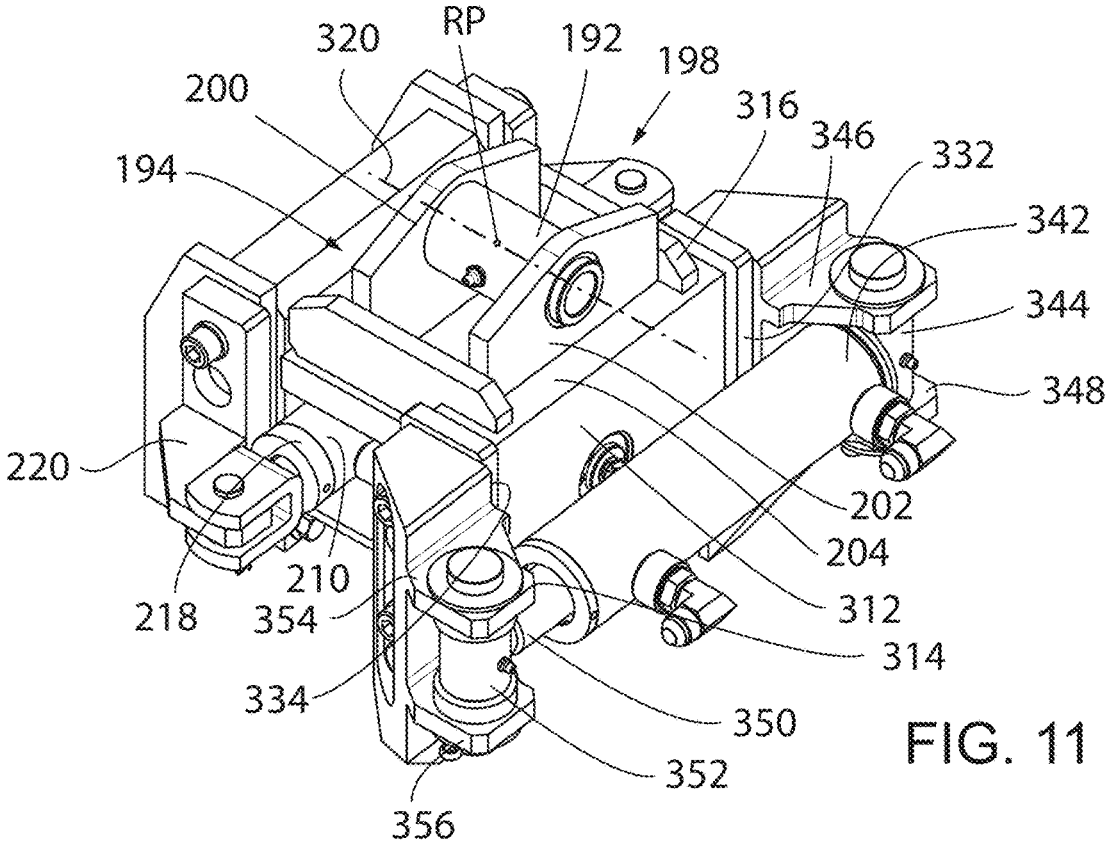
FIG. 11 is a top, second side isometric view of the tie plate inserter centering mechanism of FIG. 10.
Figure 12:
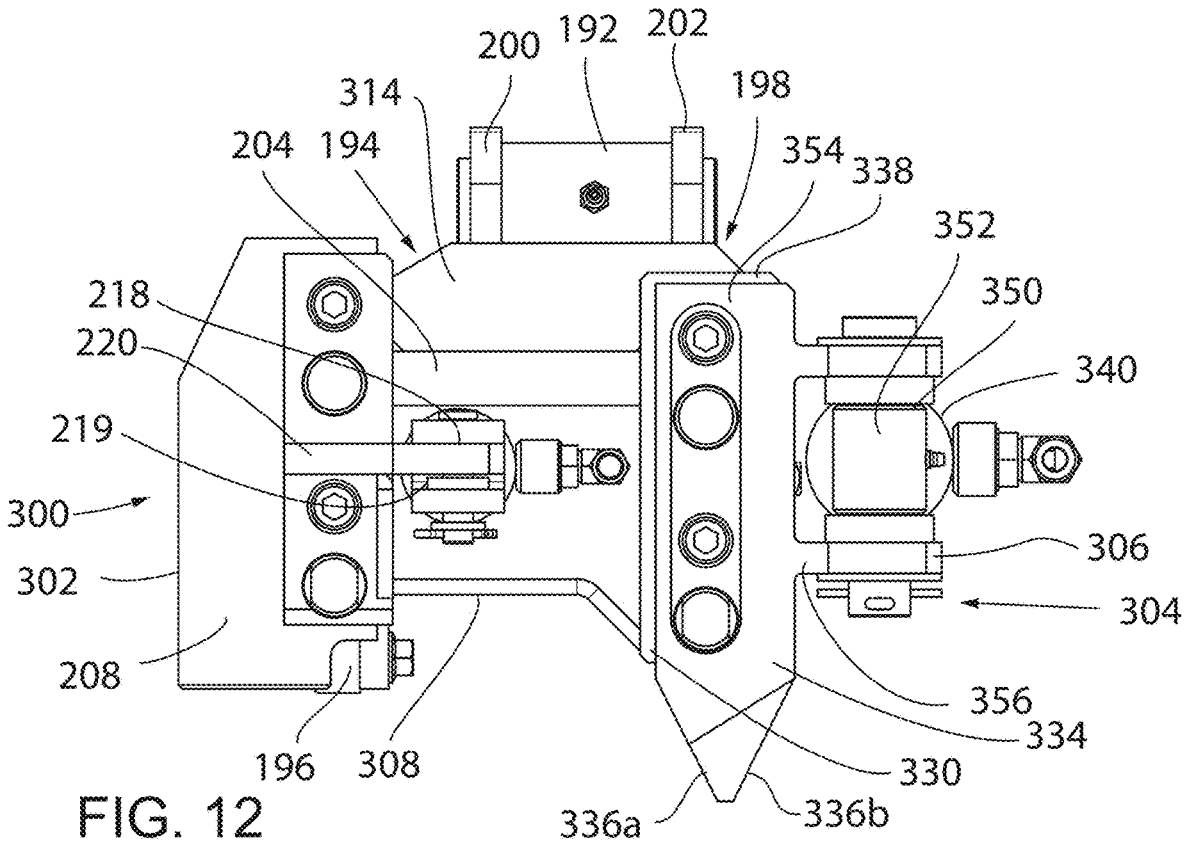
FIG. 12 is a rear elevation view of the tie plate inserter centering mechanism of FIGS. 10-11.
Figure 13:
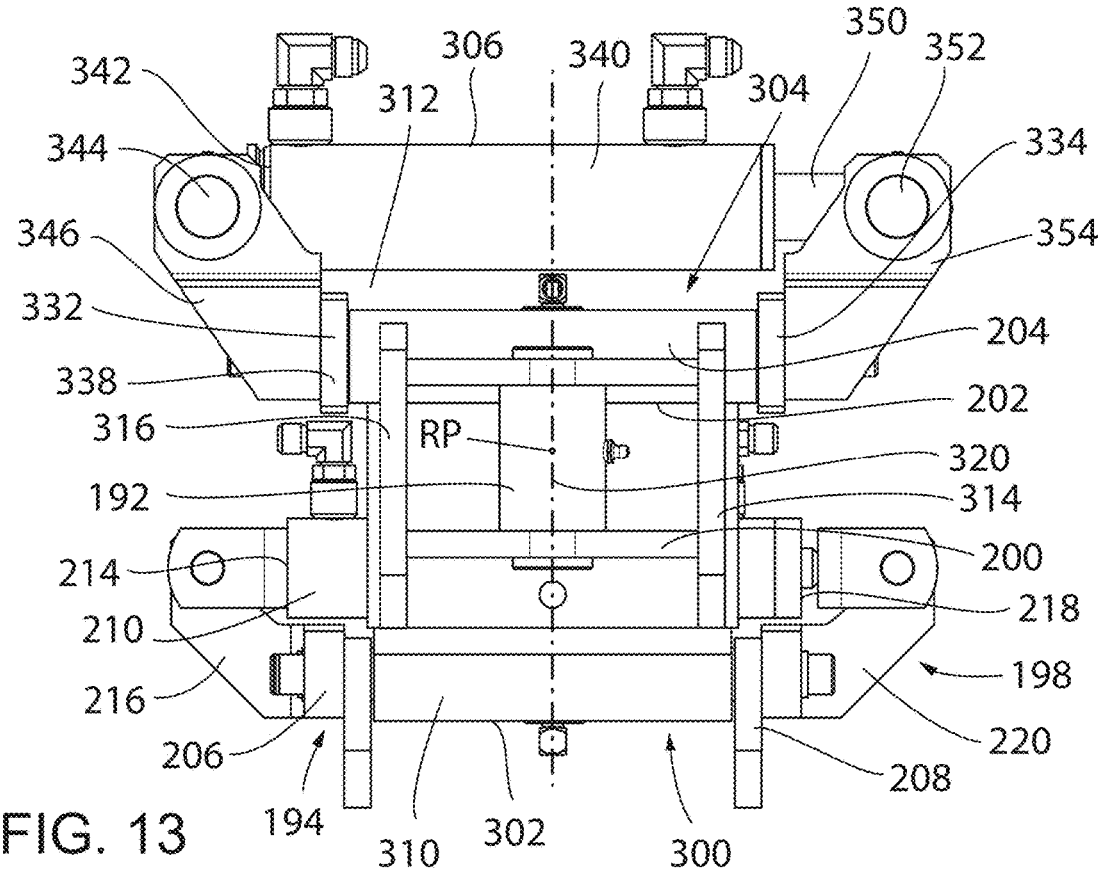
FIG. 13 is a top plan view of the tie plate inserter centering mechanism of FIGS. 10-12.

Because of the configuration of the tie plate clamp assembly 300 and the tie clamp assembly 304, the tie plate centering mechanism 198 can quickly, efficiently, and automatically cause the tie plate P to be centered relative to the longitudinal centerline of the tie T and to center both the tie plate P and the tie T relative to a reference point RP on the frame 194 at the centerline of the frame 194 (FIGS. 10-11 and 13). More specifically, the hydraulic cylinders 210, 340 can be actuated to simultaneously move the tie plate clamp plates 206, 208 and the tie clamp plates 332, 334 transversely of the tie T or longitudinal of the rail R. Additionally, due to the centering mechanisms of both the tie plate clamp assembly 300 and the tie clamp assembly 304, each of the plates 206, 208 remain equidistant to the center line 320, while each of the plates 332, 334 also remain equidistant to the center line 320. Thus, when the plates 332, 334 are secured to the tie T, the tie T remains centered relative to the reference point on the frame 194. Additionally, the plates 206, 208 also remain centered relative to the reference point RP on the frame 194 when they secure the tie plate P. Due to the significant amount of force exerted when the hydraulic cylinders 210, 340 are actuated, the tie T and tie plate P are forced into centered positions such that the position is virtually guaranteed. Otherwise, sensors could be provided to ensure the components are appropriately centered. If for whatever reason the tie plate P is not correctly position based on the reading of the sensor, the tie plate centering mechanism 198 can again be activated. Thus, the tie plate centering mechanism 198 ensures that the tie plate P is appropriately positioned in the center of the tie T before insertion.

Turning briefly to FIGS. 16-19, a similar embodiment of the tie plate centering mechanism 398 is shown. The tie plate centering mechanism 398 has many of the same components as the embodiment shown in FIGS. 10-15. As such, common components will be designated with the same reference numbers, except increased by 200. Overall, the functionality of the tie plate centering mechanism 398 is nearly identical to the tie plate centering mechanism 198, although some of the components are located in different locations. For instance, the first hydraulic cylinder 410 is located above the tie plate clamp assembly 500, and affixes to first and second plates 568, 570 to either end of the tie plate clamp assembly 500. Nevertheless, the cylinder 410 operates in the same capacity as the cylinder 210. Of course, any of the other components could similarly be moved as desired. Additionally of note, FIGS. 18 and 19 show the tie plate centering mechanism 398 with the first side mounting plate 510 and the second side mounting plate 512 removed, respectively, to show the rack-and-pinion assemblies 522, 558.

Figure 16:
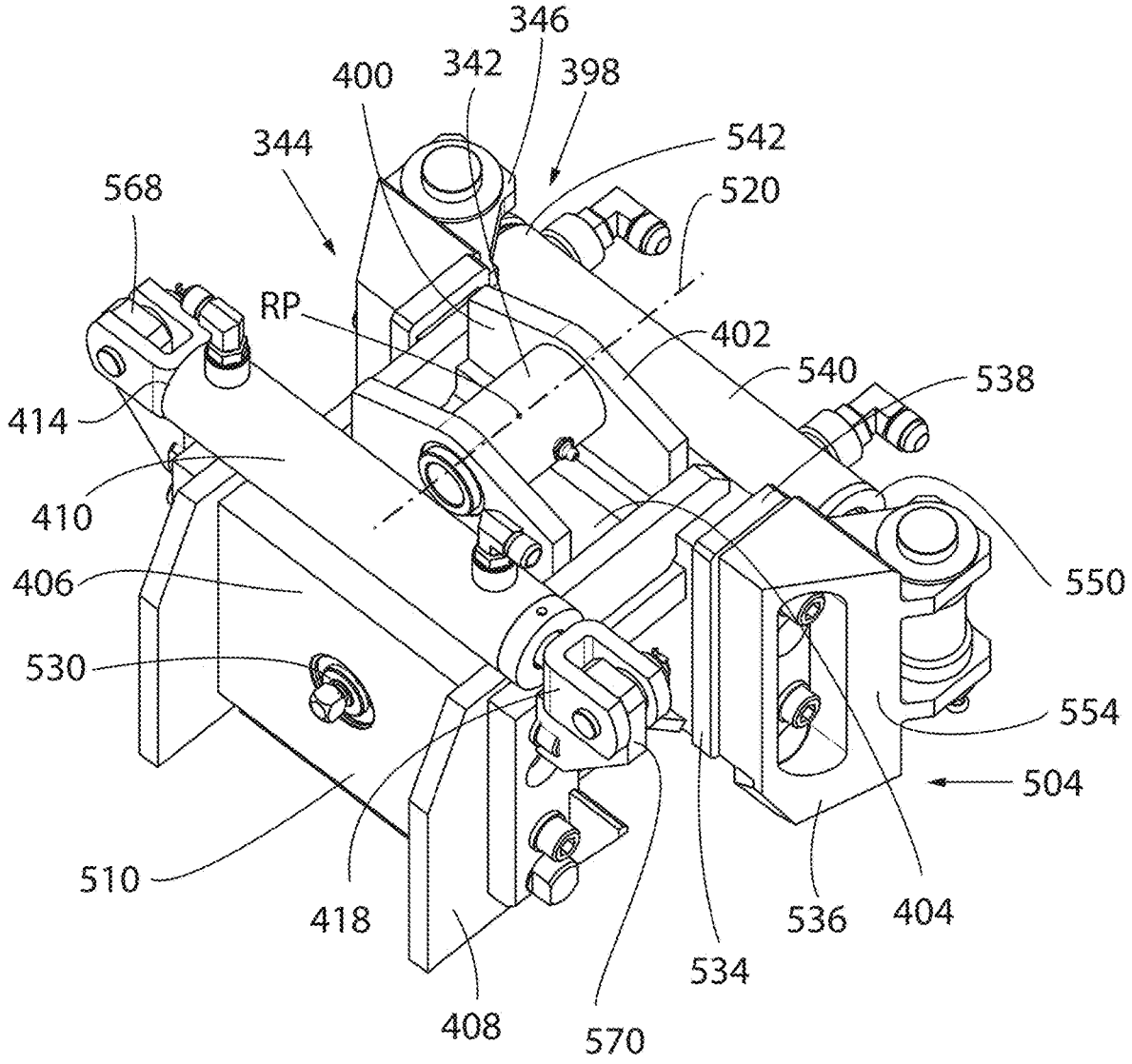
FIG. 16 is a top, first side isometric view of another embodiment of a tie plate inserter centering mechanism in a closed position.

FIGS. 17-20 show the tie plate centering mechanism 398 in the opened and the closed positions. More specifically, FIG. 16 show the tie centering plate mechanism 398 in a closed position, in which the first and second clamp plates 406, 408 of the tie plate clamp assembly 500 are clamped around a tie plate P shown in phantom, and the third and fourth clamp plates 532, 534 of the tie clamp assembly 504 are clamped around a tie T shown in phantom. As shown in FIGS. 17-19, the tie centering plate mechanism 398 is in an opened position, in which the first and second clamp plates 406, 408 of the tie plate clamp assembly 500, as well as the third and fourth clamp plates 532, 534 of the tie clamp assembly 504, are spaced apart from one another. Because these clamp plates 406, 408, 532, 534 are spaced from one another, they are not in a configuration to grip a tie plate P or a tie T.

The tie plate inserting machine 20 may incorporate measures to prevent the pusher 158 from driving a tie plate P too far beneath the rail R. For instance, limit switches or optical sensors could be provided for this purpose. In the illustrated embodiment, a backstop or "hard stop" is provided. Referring to FIGS. 6 and 7, the hard stop 230 is mounted on the foot 118 of the jack 94. The hard stop 230 includes a housing 232 and a pair of tapered pins 234, 236 that extend downwardly from the housing 232. The pins 234, 236 are mounted in the housing by horizontal cross pins 238, 240. The cross pins 238, 240 extend through elongated slots 242, 244 in the housing 232, hence allowing the pins 234, 236 to float vertically relative to the housing 232 to prevent damage to the pins 234, 236 should they encounter ballast or the like when the jack 94 engages the tie T. The position of the housing 232 and, therefore, the hard stop 230 as a whole, is preferably adjustable so as to accommodate different length tie plates P. Towards this end, the housing 232 is mounted on a pair of guide rods 246, 248 that are telescopically received in guide tubes 250, 252 mounted within the foot 118 of the jack 94. A hydraulic cylinder 254 is disposed between the guide tubes 250, 252 and has a barrel end 256 affixed to the stationary jack foot 118 and a rod end 258 attached to the housing 232. Extension or retraction of the cylinder 254 moves the housing 232 toward or away from the gauge side of the rail R.

As mentioned briefly above, the tie plate inserting machine 20 is controlled via operator manipulated controls 36 located adjacent the seat 34. These controls include left and right joysticks, the right one 260R of which is seen in FIG. 1. The joysticks are identical in construction and operation with each being operable to control one of the tie plate inserter assemblies 44L, 44R. The right joystick 260R will now be described, it being understood that the discussion applies equally to the left joystick.

Figure 21:
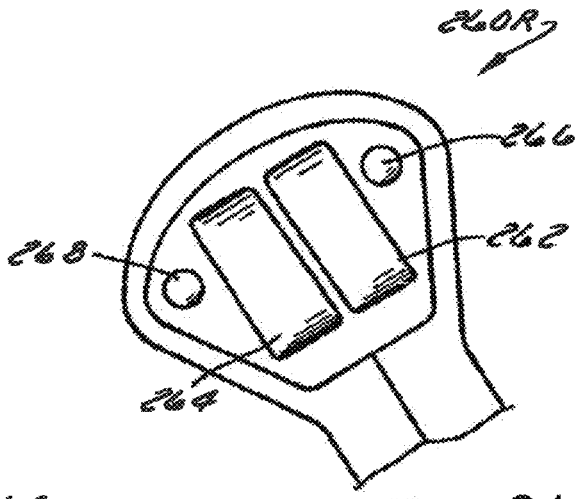
FIGS. 20 and 21 are side elevation and front plan views, respectively, of a portion of a joystick of the tie plate inserting machine.
Figure 20:
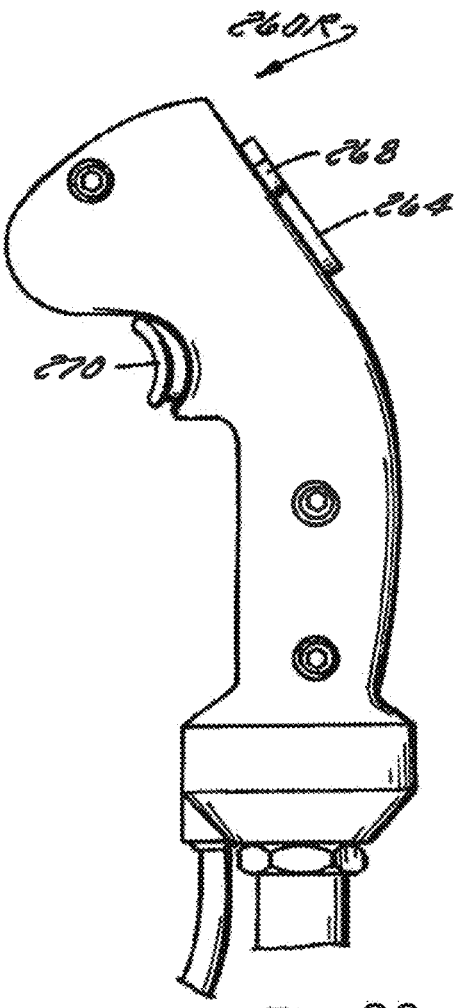

Referring to FIGS. 20 and 21, the joystick 260R is a two axis joystick moving fore and aft and side to side. It also has first and second toggle switches 262, 264 and first and second push button switches 266, 268 on its front surface and a trigger 270 on its back surface. Manipulation of these elements in the following manner results in the following operation:

- side to side motion of joystick 260R results in extension/retraction of cylinder 148 and pusher motion toward/away from the rail R;
- fore/aft motion of joystick 260R results in extension/retraction of cylinder 168 and raising/lowering of the pusher;
- forward/reverse depression of toggle switch 262 extends/retracts the cylinder 155 to move the tie plate inserter assembly 44R forward/backward;
- forward/reverse depression of the toggle switch 264 extends/retracts cylinder 122 to extend/retract the jack 94;
- depression of push button switch 266 extends/retracts cylinder 155 to open/close the plate clamp assembly 198;
- depression of push button switch 268 extends/retracts cylinder 100 to open/close the rail clamp 92;
- actuation of the trigger 270 initiates an auto-clamping and rail lifting operation, and release of the trigger 270 returns all components of the system to their "home" position.

The toggle switches 262 and 264 are proportional in nature such that each successive toggle moves the associated cylinder 155 and 122 an additional increment. Conversely, actuation of the push button switches 266 and 268 merely triggers an automatic operation such as complete cylinder retraction, complete cylinder extension and/or cylinder pressurization up to a preset limit. The trigger 270 can be actuated as an alternative to individually manipulating the switches 264 and 266. That is, by simultaneously actuating the trigger 270 and the push button switch 266, the rail clamping operation and rail lifting operation are performed automatically and sequentially without any other operator input. The operator holds the trigger 270 until the tie plates P are installed and then releases the trigger 270 to automatically retract the jack 94 and unclamp the rail R. The release of the trigger 270 also returns all cylinders to return the inserter assembly 44R to its retracted or home position. In this case, the jack extend switch 264 acts as an override switch that overrides the automatic operation initiated by the trigger to assure adequate jack extension should the jack 94 encounter an obstruction during the automatic operation.

Other controls, such as those required to actuate the cylinders 64 and 66 to raise and lower the workhead and to operate the cylinder 90 to center the workhead 28 over the railway, while not shown, may comprise switches, levers, or any other suitable controls available to those skilled in the art.

The tie plate inserting machine 20 as described above operates as follows when used in tie replacement setting.

First, the operator transports the machine 20 to the worksite with the workhead 28 in its travel position due to the retraction of cylinders 64 and 66. Prior to this operation, laborers and a combination of one or more machines would have removed the old ties T from the railway, inserted the new ties T, and cleaned ballast or other debris from the top of the ties T. Importantly, and unlike with prior tie plate inserting machines, new or used tie plates P are also set on the ties T adjacent the field side of the rails R prior to insertion of the tie plate by the tie plate inserting machine 20. This setting may occur either well in advance or just ahead of operation of the tie plate inserting machine 20.

Upon arrival at the worksite, the operator extends the cylinders 64, 66 to lower the workhead 28 to its travel position in which the rollers 76 rest on top of the rails R. If necessary, he or she may actuate the cylinder 90 to move the entire workhead 28 side to side as necessary to center the rail clamps 92 over the rails R. This centering may be performed manually by inspection or with the assistance of sensors such as a laser-based sensor. At this time, the cylinders 168, 148 are in positions in which the pusher is raised away from the tie T and is positioned well outboard of the field end of the tie plate P, and the tie plate clamp assembly 198 is open. Next, the operator centers the workhead 28 over the longitudinal centerline of the tie T. At this time, the hard stop 230 is positioned inboard of the gauge side of the rail R in general alignment with the gauge end of the tie plate P. The spacing between the hard stop 230 and the rail R is set by suitable actuation of cylinder 254. However, as indicated above, this actuation is not performed on a cycle-by-cycle basis but instead is a "set and forget" function that sets the spacing for a given tie plate and tie configuration.

The operator then engages the trigger 270 and the switch 266 of each joystick to first engage the associated rail clamp 92 and then extend the jack 94 to lift the rails R to the position seen in FIGS. 6-9. The operator then moves the joysticks 260 forward to lower the push plate 196 of each pusher 158 into the same vertical plane as the field end of the associated tie plate P. If necessary, the operator also engages the switch 254 to at least generally align the longitudinal centerline of the push plate 196 with the end of the tie plate P. It should be noted, however, that this operation might not be necessary in every instance. Both alignments may be performed either manually solely by inspection and/or with feedback from sensors and/or monitors (not shown).

Next, the operator moves each joystick 260 inboard to move the pusher 158 toward the associated tie plate P. More specifically, the operator may move the pusher 158 to a location where center of the frame 194 is located at the location where the centerline of the tie T and tie plate P will be located relative to the rail R. If desired, the operator may operate the switch 266 to close the tie plate centering mechanism 198 as the push plate 196 approaches the field end of the tie plate P so as to ensure the tie plate P is centered relative to the longitudinal centerline of the tie T.

More specifically, once the operator operates the switch 266, the first clamp plate 206 and the second clamp plate 208 of the tie plate clamp assembly 300 are moved to clamp against the tie plate P, so that the tie plate P is centered relative to the reference point RP (FIGS. 10, 11, and 13). For instance, as explained above, the first and second clamp plate 206, 208 may remain equidistant from a center of the frame 194 while they move towards or away one another. Such movements of the clamp plates 206, 208 may be achieved using the hydraulic cylinder 210 (FIGS. 10-15) or the rack and pinon assembly 322 (FIGS. 16-21). Alternatively still, only one of the first and second clamp plates 206, 208 may move relative to the other, while still clamping the tie plate P in a centered position relative to the tie T. In doing so, the tie plate P may be moved transversely of the tie T until it is centered on the tie T.

Simultaneously, the first clamp plate 332 and the second clamp plate 334 of the tie clamp assembly 304 of the tie clamp assembly 304 are moved relative to one another to center the tie T relative to the reference point RP. For instance, as described above the clamp plates 332, 334 may remain equidistant from a center of the frame 194 while they move towards or away from one another. Alternatively, only one of the first and second clamp plates 332, 334 may move relative to the other, while still clamping the tie T in a centered position relative to the reference point RP. Movement of one or both of the clamp plates 332, 334 may also be achieved by operating the switch 266. Alternatively, a second switch (not shown) could be provided that would enable the operator to actuate only the tie plate clamp assembly 300 or the tie clamp assembly 304. Because both the tie plate P and the tie T will be centered relative to the reference point RP, by extension the tie plate P is also centered related to the tie T.

Further still, at least one sensor (not shown) can monitor the location of the tie plate P relative to the tie T. If, for whatever reason, the tie plate P is not centered relative to the tie T, the tie plate clamp assembly 300 can be actuated so as to move the clamp plates 206, 208 away from the tie plate P to an open position, after which they can again be actuated so as to clamp against the tie plate P so that it is centered relative to the tie T.

Next, the operator moves each joystick 260 inboard so that the push plate 196 first engages then pushes to the associate tie plate P beneath the rail R until the gauge end of the tie plate contacts the pins 234 and 236 of the hard stop 230 to arrest further tie plate movement as seen in FIG. 9. The tie plate insertion process is now complete. If operating in "auto" mode, the operator need only release the trigger 260, and each tie plate inserter assembly 44L, 44R automatically returns to its home position, the jacks 94 are retracted to lower the rail R onto the tie plate P, and the rail clamps 92 are released. These operations may alternatively be performed manually by suitable manipulation of the joysticks and switches. The operator then drives the machine 20 to the next tie, where the sequence is repeated.

The process as described above is very reliable and can be performed very rapidly due to the fact that the insertion process is automatic, yet no complex dispensing and transport mechanisms need be activated to set a tie plate P adjacent the rail R. Indeed, experiences has shown the entire process, from engagement of the rail clamp, through tie plate insertion, and to release the rail clamp can be performed in under 10 seconds and, in fact, in as little as 5-7 seconds. This is a dramatic improvement over prior known machines.

As indicated above, many changes and modifications may be made to the present invention without departing from the spirit thereof. The scope of some of these changes is discussed above. The scope of others will become apparent from the appended claims.

What is claimed is:

1. A tie plate inserter assembly comprising:

a) a frame comprising first and second sides and a centerline extending from the first side to the second side;

b) a tie clamp assembly that is movably connected to the frame at the first side and that includes a tie self-centering mechanism that is selectively operable to engage and center a tie about the centerline of the frame; and c) a tie plate clamp assembly that is movably connected to the frame at the second side and that includes a tie plate self-centering mechanism that is selectively operable to engage and center a tie plate relative to a longitudinal centerline of the tie;

wherein the tie self-centering mechanism comprises a rack and pinion mechanism.

2. The tie plate inserter assembly of claim 1, wherein the tie plate clamp assembly further comprises first and second clamp plates located on opposite sides of the centerline, and wherein the tie plate self-centering mechanism is configured to ensure that the first clamp plate and the second clamp plate are equidistantly located from a reference point on the frame.

3. The tie plate inserter assembly of claim 2, wherein the tie clamp assembly further comprises third and fourth clamp plates located on opposite sides of the centerline, and wherein the tie self-centering mechanism is configured to ensure that the third clamp plate and the fourth clamp plate are equidistantly located from the reference point in the frame.

4. The tie plate inserter assembly of claim 3, wherein the tie plate clamp assembly further comprises a first hydraulic cylinder;

wherein the first hydraulic cylinder is actuatable to move the tie plate clamp assembly from an opened position in which the tie plate is spaced from at least one of the first clamp plate and the second clamp plate, to a closed position where the tie plate is engaged by and clamped between the first clamp plate and the second clamp plate.

5. The tie plate inserter assembly of claim 4, wherein the tie clamp assembly further comprises a second hydraulic cylinder;

wherein the second hydraulic cylinder is actuatable to move the tie clamp assembly from an opened position in which the tie is spaced from at least one of the third clamp plate and the fourth clamp plate, to a closed position where the tie is engaged by and clamped between the third clamp plate and the fourth clamp plate.

6. The tie plate inserter assembly of claim 1, wherein the tie plate self-centering mechanism comprises a rack and pinion mechanism.

7. A method of centering a tie plate relative to a tie using a tie plate inserter assembly, comprising the steps of:

a) locating a frame of the tie plate inserter assembly relative to the tie and the tie plate, the tie plate inserter assembly comprising a centerline and first sides on opposite sides of the centerline;

b) clamping a tie clamp assembly to a tie using a tie self-centering mechanism, the tie clamp assembly being located on the first side of the centerline of the frame; and c) clamping a tie plate clamp assembly to a tie plate using a tie plate self-centering mechanism to center the tie plate relative to the tie, the tie plate assembly being located on the second side of the centerline of the frame;

d) relatively moving a first clamp plate and a second clamp plate of the tie clamp assembly towards one another to position the tie at the centerline of the frame; and e) relatively moving a third clamp plate and a fourth clamp plate of the tie plate clamp assembly towards one another to position the tie plate at the centerline of the tie;

determining a position of the tie plate relative to the tie using at least one sensor;

returning the tie plate clamp assembly to an opened position based on readings of the at least one sensor; and then moving the third clamp plate and the fourth clamp plate towards one another to clamp the tie plate at the centerline of the frame.

8. The method of claim 7, further comprising:

a) actuating the tie self-centering mechanism so that the first clamp plate and the second clamp plate remain equidistant from the centerline of the frame; and b) actuating the tie plate self-centering mechanism so that the third clamp plate and the fourth clamp plate remain equidistant from the centerline of the frame.

9. The method of claim 7, further comprising:

a) actuating a first hydraulic cylinder to clamp the first clamp plate and the second clamp plate to the tie; and b) actuating a second cylinder to clamp the third clamp plate and the fourth clamp plate to the tie plate.

10. The method of claim 7, further comprising:

rotating a pinion of a rack and pinion mechanism to translate a first linear gear of the rack and pinion mechanism in a first direction transverse to the centerline of the frame; and translating a second linear gear of the rack and pinion mechanism with the pinion in a second direction opposite the first direction transverse to the centerline of the frame;

wherein the first linear gear is associated with the first clamp plate;

wherein the second linear gear is associated with the second clamp plate; and wherein the first clamp plate and the second clamp plate remain equidistant from the centerline of the frame during pinion rotation.

11. A machine for centering a plurality of tie plates relative to a plurality of ties, the machine comprising a chassis configured to be supported on opposed rails by wheels and having first and second sides;

a first tie plate inserter assembly supported on the first side of the chassis; the first tie plate inserter assembly including:

a. a first support frame having first and second sides located and a centerline extending through the center of the first support frame from the first side to the second side;

b. a first tie clamp assembly which is located on the first side of the first support frame and which includes a first tie self-centering mechanism that selectively engages a tie; and c. a first tie plate clamp assembly which is located on the second side of the first support frame and which includes a first tie plate self-centering mechanism that selectively engages a first tie plate and centers the first tie plate about the tie:

wherein the first the plate clamp assembly has a first set of first and second apposed clamp plates are movable, elative to one another, between:

an open position in which at least one of the first set of opposed clamp plates is spaced from the first the plate; and a closed position in which both clamps of the first set of opposed clamp plates are secured against the first the plate; and wherein the first tie clamp assembly has a second set of first and second opposed clamp plates that are movable, relative to one another, between:

an open position in which at least one of the clamps of the second set of opposed clamp plates is spaced from the tie; and a closed position in which both clamps of the second set of opposed clamp plates are secured against the tie;

wherein each clamp of the second set of opposed clamp plates comprise:

a top portion;

a first tapered edge extending downwardly; and a second tapered edge extending downwardly towards the first tapered edge;

wherein the first and second tapered edge meet to form a wedge configured to engage the tie.

12. The machine of claim 11, further comprising:

a second tie plate inserter assembly supported on a second side of the chassis and including:

a. a second support frame having a first side, a second side, and a centerline extending through a center of the second support frame from the first side to the second side;

b. a second tie clamp assembly which is located on the first side of the second support frame and which includes a second tie self-centering mechanism that selectively engages the tie; and c. a second tie plate clamp assembly which is located on the second side of the second support frame and which includes a second tie plate self-centering mechanism that selectively engages a second tie plate and centers the second tie plate about the tie.

13. The machine of claim 12, wherein the first tie self-centering mechanism comprises:

a pinion at a center point of the second side of the first support frame;

a first rack, associated with one of the first set of opposed clamp plates, that is engaged by the pinion; and a second rack, associated with the other of the first set of opposed clamp plates, that is engaged by the pinion;

wherein the first rack is moved in a first direction when the pinion is rotated in a clockwise direction;

wherein the second rack is moved in a second direction opposite the first direction when the pinion is rotated in a clockwise direction; and wherein the first set of opposed clamp plates remain equidistant from the pinion upon pin rotation.

14. The machine of claim 11, wherein the clamps of the first set of opposed clamp plates remain equidistant relative to a center point of the first support frame while the clamps of first set of opposed clamp plates move from the open position to the closed position; and wherein the clamps of the second set of opposed clamp plates remain equidistant relative to a center point of the first support frame while the clamps of the second set of opposed clamp plates move from the open position to the closed position.

15. The machine of claim 11, further comprising:

a first hydraulic cylinder that is actuatable to move the clamps of first set of opposed clamp plates between the open and closed positions; and a second hydraulic cylinder that is actuatable to move the clamps of the second set of opposed clamp plates between the open and closed positions.

* * * * *